US008632346B2

(12) United States Patent
Wittig et al.

(10) Patent No.: US 8,632,346 B2
(45) Date of Patent: Jan. 21, 2014

(54) CONNECTION ASSEMBLY ON CIRCUIT BOARDS

(75) Inventors: Klaus Wittig, Öhringen (DE); Werner Kallee, Bad Friedrichshall (DE)

(73) Assignee: Wuerth Elektronik ICS GmbH & Co. KG, Oehringen (DE)

( * ) Notice: Subject to any disclaimer, the term of this patent is extended or adjusted under 35 U.S.C. 154(b) by 0 days.

(21) Appl. No.: 13/132,541

(22) PCT Filed: Dec. 2, 2009

(86) PCT No.: PCT/EP2009/008591

§ 371 (c)(1),
(2), (4) Date: Aug. 5, 2011

(87) PCT Pub. No.: WO2010/063459

PCT Pub. Date: Jun. 10, 2010

(65) Prior Publication Data

US 2012/0108083 A1 May 3, 2012
US 2013/0078828 A2 Mar. 28, 2013

(30) Foreign Application Priority Data

Dec. 3, 2008 (EP) ..... 08020940
Jun. 17, 2009 (EP) ..... 09163009

(51) Int. Cl.
*H01R 12/00* (2006.01)

(52) U.S. Cl.
USPC ..... 439/82; 439/567; 439/553

(58) Field of Classification Search
USPC ..... 439/862, 857, 660
See application file for complete search history.

(56) References Cited

U.S. PATENT DOCUMENTS 3,209,309 A 9/1965 Tannenbaum et al.
3,820,061 A 6/1974 Holden (Continued)

FOREIGN PATENT DOCUMENTS

DE 26 31 612 A1 4/1977
DE 73 28 667 11/1977

(Continued)

*Primary Examiner* — Neil Abrams
*Assistant Examiner* — Phuongchi T Nguyen
(74) *Attorney, Agent, or Firm* — Robert A. Blaha; Smith Risley Tempel Santos LLC

(57) ABSTRACT

A connection arrangement with a plug element and a circuit board with plated-through holes. The plug element has a plurality of pluggable contact elements. The plated-through holes are arranged in an arrangement corresponding to the arrangement of the contact elements of the plug element. The plated-through holes and the contact elements that can be plugged into them, are matched to one another such that the plug element is manually connectable to the circuit board by inserting the contact elements into the plated-through holes and the plug element is manually removable. The contact elements are simultaneously pluggable into their associated plated-through holes. The contact elements include two legs having a space between them, with both legs of each contact element pluggable into a respective plated-through hole.

19 Claims, 15 Drawing Sheets

(56) References Cited

U.S. PATENT DOCUMENTS

| | | | | |
|---|---|---|---|---|
| 4,111,518 | A | 9/1978 | Zurcher | |
| 4,676,579 | A * | 6/1987 | Ting | 439/825 |
| 5,630,720 | A * | 5/1997 | Kocher | 439/78 |
| 5,827,094 | A * | 10/1998 | Aizawa et al. | 439/857 |
| 7,137,848 | B1 | 11/2006 | Trout et al. | |
| 7,878,834 | B2 | 2/2011 | Sherman et al. | |
| 8,075,322 | B2 | 12/2011 | Schwettmann et al. | |
| 2002/0106930 | A1 | 8/2002 | Pape et al. | |
| 2004/0097141 | A1 * | 5/2004 | Belopolsky et al. | 439/857 |
| 2006/0110955 | A1 * | 5/2006 | Blossfeld | 439/82 |
| 2007/0270001 | A1 | 11/2007 | Matsumura | |
| 2008/0200073 | A1 | 8/2008 | Mermaz et al. | |
| 2010/0144171 | A1 * | 6/2010 | Lechner et al. | 439/78 |
| 2010/0279523 | A1 | 11/2010 | Schwettmann et al. | |

FOREIGN PATENT DOCUMENTS

| | | | |
|---|---|---|---|
| DE | 42 26 172 | A1 | 2/1994 |
| DE | 19830957 | A1 | 1/2000 |
| DE | 100 47 457 | A1 | 4/2002 |
| EP | 0 203 638 | A2 | 12/1986 |
| EP | 0 884 801 | A2 | 6/1998 |
| EP | 1 069 651 | A1 | 1/2001 |
| EP | 1 791 215 | A2 | 5/2007 |
| WO | WO2007009791 | A1 | 1/2007 |
| WO | WO2007145764 | A2 | 12/2007 |

* cited by examiner

CONNECTION ASSEMBLY ON CIRCUIT BOARDS

CROSS REFERENCE TO RELATED APPLICATIONS

This application claims the priority of the European patent application EP 08020940.6, filed on Dec. 3, 2008, and claims the priority of the European patent application EP 09163009.5, filed on Jun. 17, 2009.

TECHNICAL FIELD

The invention is based on an arrangement for electrically and mechanically connecting plug elements by means of a base with a circuit board, which is designed for high electrical and mechanical requirements.

BACKGROUND

IPC class HO1R 13/53 relates to base plates or housings for high electrical requirements. IPC class HO1R 13/533 relates to base plates or housings for use under extreme conditions, e.g. high temperature, radiation, vibration, corrosive environments, pressure.

Plug connectors for making electrical and/or electronic connections between different components, leads or the like are known, which consist of a plug element and a socket element. For example, there are standard sockets, into which plugs can be plugged, that are attached to ends of leads. Connection arrangements of this kind are also suitable and designed for very frequent establishing and releasing the connection.

In the case of relays, fuses or the like it is also known to mount on a device a base, into which the fuse or relay can be inserted. In this case also, replacement is supposed to be possible, albeit replacement is less common than in the case of plugging processes between socket and plug.

Even when plugging processes between circuit boards and plug elements are involved, it is common practice to arrange a base or a socket on the circuit board, or even at another location, and then to connect the socket to the circuit board using leads.

WO 2007/145764 relates to connectors for power transmission, in which the heat produced can lead to creep of a plastic housing. One connector comprises a connector housing and power contacts. An associated connector contains a connector housing and multiple power contacts, which are accessible through accessible through openings. Furthermore, the connectors can be connected to each other and mounted on circuit boards. A power contact can be employed in the connector. Further, terminals comprising fixing features of a printed circuit board are provided.

U.S. Pat. No. 7,137,848 discloses a central housing with a board mounting interface. Power and signal contacts are also provided. These can be configured as eyelet pins for a press fit connection to holes, such as, for example vias of a printed circuit board. The central housing further contains latch openings for receiving latch elements, which are equipped for snapping engagement of matching latch features of a circuit board, at which the central housing can be mounted.

EP 0,884,801, DE 100 47 457 and DE 42 26 172 each disclose connectors that are based on the establishment of press fit connections.

EP 1,069,651 A1 discloses a metal terminal which is inserted into a contact hole of an electrical circuit substrate and establishes an electrical contact at the contact hole. The terminal has a stop element, which impinges against the substrate at the rear end of the contact hole, whereby further insertion of the terminal into the contact hole is prevented. A removal prevention segment impinges against the substrate on the front side of the contact hole, in order to prevent an unwanted withdrawal of the terminal. The removal prevention segment is springly deformable, in order to allow it to be guided through the contact hole during the insertion of the terminal. Contact elements between the stop element and the removal prevention segment establish an electrical contact in the contact hole.

However, tests on a metallic connector, such as that described, have shown that the removal prevention segment, graphically adapted in the form of a ring, is easily plastically deformed during insertion through the contact hole, and is therefore often destroyed. Put another way, the guiding of this wide removal prevention segment through a narrow contact hole and the requirement to generate a sufficiently high retaining force by means of the removal prevention segment represent an insurmountable technical contradiction with the system of EP 1,069,651 A1.

Moreover, the terminal disclosed in EP 1,069,651 A1 is difficult for a user to manually operate. In particular, if multiple contacts are made at the same time, this requires the application of a very large manual force to push the removal prevention segment through the contact hole, which rapidly places excessive demands on the skills of a human user, if a sufficiently high retaining force is to be obtained in the inserted condition thereafter. Further, the mechanical strain that acts on the board according to EP 1,069,651 A1 is large. Multiple plugging according to a base-plug method is also impossible with such a system, since high retaining forces lead to plastic deformations of the removal prevention segment.

SUMMARY

The problem addressed by the invention is to create a connection arrangement that is substantially simpler in construction and that largely eliminates the possibilities of faulty operations or malfunctions, wherein a sufficiently strong fixing effect is to be achieved with good manual operability.

For a solution to this problem the invention proposes a connection arrangement, a plug element, a vehicle and an application having the features cited in the independent claims. Extensions of the invention form the subject matter of dependent claims.

According to one exemplary embodiment of a first aspect of the invention, a connection arrangement is created, having a plug element comprising at least one contact element, in particular a plurality (which means at least two) of pluggable (for example high-current capable) contact elements, and having a circuit board with plated-through holes (exactly one hole is also possible), which are arranged in an arrangement corresponding to the arrangement of the contact element or the contact elements of the plug element, wherein the (through) holes and the contact element or contact elements pluggable into them are matched to each other in such a manner that the plug element can be manually connected to the circuit board by inserting the contact element or contact elements into the holes and can be removed manually, wherein the connection arrangement is provided with a vibration-robust mechanical safeguard against unintentional withdrawal of the plug element from the circuit board. The contact element or contact elements can optionally be configured as a spring-type contact element or spring-type contact elements with a reversible deflection characteristic.

According to another exemplary embodiment of the first aspect of the invention, a plug element for a connection arrangement for connecting to a circuit board with plated-through holes is created, wherein the plug element comprises at least one contact element, in particular a plurality of pluggable (for example high-current capable) contact elements, wherein the plated-through holes are arranged in an arrangement corresponding to the arrangement of the contact element or the contact elements of the plug element, wherein the holes and the contact element or contact elements pluggable into them are matched to one another such that the plug element can be connected to the circuit board by hand by inserting the contact element or contact elements into the holes and can be removed by hand, and wherein the connection arrangement is provided with a vibration-robust mechanical safeguard against unintentional withdrawal of the plug element from the circuit board. The contact element or contact elements can be optionally configured as a spring-type contact element or spring-type contact elements with a reversible deflection characteristic.

According to a still other embodiment of the first aspect of the invention a vehicle (for example a powered vehicle, a passenger car, a motor truck, a bus, a powered agricultural vehicle, a baling press, a combine harvester, a self-propelled sprayer, a road building machine, a tractor, an aircraft, an airplane, a helicopter, a spaceship, a Zeppelin, a water-borne vehicle, a ship, a railway vehicle or a train) is created, comprising a connection arrangement with the features described above or a plug element with the features described above.

According to a further embodiment of the first aspect of the invention a connection arrangement with the features described above is used for transmitting an electrical current of at least approximately 5 Amperes, in particular of at least approximately 10 Amperes, further in particular of at least approximately 20 Amperes, between a contact element (in particular between each individual of the contact elements) of the plug connector and the circuit board attached thereto. Corresponding contact elements may also be referred to as high-current capable contact elements.

The term "high-current capable contact elements" may in particular mean that the contact elements are designed with respect to dimension, material, mutual separation, etc. in such a manner that they are suitable for carrying a high electrical current. Put another way, when using high-current capable contact elements, an electrical current in the Ampere range can be transmitted from the contact elements to the conductor paths. The term "high current" can be used in particular, when the contact elements are specially adapted to be able to transport at least 5 Amperes per contact element, in particular at least 10 Amperes per contact element, without jeopardizing the intended usage of the connection arrangement. Put another way, the contact elements in a high current configuration are to be adapted so that undesired heating of the connection arrangement is avoided or another technical function of the connection arrangement is subjected to damage, when such high currents are conducted by means of the contact elements. In particular, the high-current carrying capable configuration of the contact elements may be designed so that the contact elements can jointly carry cumulative currents of at least 50 Amperes, in particular of at least 100 Amperes. The high-current capability of the contact elements may be regarded as given when the contact elements are connectable to a vehicle battery and can supply current failure-free from the vehicle battery to the connected circuit board. The high-current capability can be regarded as given in particular, when transition resistances according to the insertion standard satisfy the requirements of IEC 60512-2.

According to a further embodiment of the first aspect of the invention the contact element or the plurality of pluggable contact elements is or are high-current capable.

According to a further embodiment of the first aspect of the invention, in the connection arrangement all contact elements of a plug element are produced integrally from a single piece of sheet metal by punching and bending.

According to a further embodiment of the first aspect of the invention in the connection arrangement the mechanical safeguard is adapted to connect the plug element and the circuit board with a mechanical loading capacity according to ISO 16750, in particular according to ISO 16750-3, further in particular according to ISO 16750-3:2007.

According to a further embodiment of the first aspect of the invention in the plated-through holes and the contact element or contact elements pluggable into the plated-through holes are adapted to provide an electrical loading capacity according to ISO 16750-2, in particular according to ISO 16750-2: 2006.

According to a further embodiment of the first aspect of the invention the plug element is fitted with the mechanical safeguard against unintentional withdrawal of the plug element from the circuit board.

According to a further embodiment of the first aspect of the invention the circuit board is fitted with the mechanical safeguard against unintentional withdrawal of the plug element from the circuit board.

According to a further embodiment of the first aspect of the invention a surface of the circuit board that is free of the plated-through holes can be covered with, in particular coated or cast with, a module protective material.

According to a further embodiment of the first aspect of the invention the vibration-robust mechanical safeguard is adapted as at least one screw element, which is configured to engage in a correspondingly designed threaded sleeve of the circuit board.

According to a further embodiment of the first aspect of the invention the vibration-robust mechanical safeguard is adapted as at least one expanding rivet, which is configured to engage in a correspondingly designed rivet receiving opening of the circuit board.

The term "vibration-robust mechanical safeguard" can mean in particular that, even in the presence of vibrations which act on the technical system comprising the connection arrangement, unintentional detachment of the plug element from the circuit board is prevented. In particular, vibrations such as occurring in a motor-powered, in particular a combustion-engine powered device (in particular a vehicle), do not lead to any negative influence of the system function, when a mechanical safeguard with a vibration-robust configuration is used. In particular, during installation of the connection arrangement in the engine compartment of an off-road vehicle, the vibrations that normally occur there should not lead to undesired loss of the electrical contact between the contact elements and the opposing contact in the respectively assigned hole of the circuit board. Therefore, to obtain the vibration robustness, the mechanical safeguard can be designed with respect to material, dimensions, attachment forces, etc., so that the corresponding vibrations do not lead to an undesired detachment of the plug element from the circuit board. In order to realize the vibration robustness the connection arrangement can be configured in accordance with the industrial standard ISO TS 16750, in particular ISO TS 16750-3. ISO 16750 defines a standard for mechanical loading requirements for off-road vehicles. In order to obtain the vibration robustness the connection arrangement may further be designed to comply with the IEC 60512-4 standard, in particular to comply with at least one of the sub-requirements according to IEC 68.2.6 (vibration sinusoidal), IEC 68-2-27 and IEC 68-2-29 (multiple shocking), IEC 68-2-64 (broad band noise), IEC-68-2-64 (vibration in cold atmosphere) and IEC-68-2-50 and IEC-68-2-51 (vibration in warm atmosphere).

In the context of this description the terms insertability or removability of the plug element "by hand" can in particular be understood to mean that the insertion and removal forces, even when multiple contact elements are provided, for example at least five contact elements (in particular at least ten contact elements), are sufficiently small that they can be exerted by the muscle force of an average adult human user.

The term "unintentional withdrawal of the plug element from the circuit board" may mean in particular that the safeguard reliably prevents an undesired removal of the plug element by a user. This term is also intended however to express that an undesired detachment of the connection by engine-induced vibrations or the like is prevented. The term "withdrawal" therefore in particular comprises both an active pulling action and a detachment caused by external influences without the involvement of a user.

The plug element or contact element may locally displace metallic material of the plated-through sleeve or hole in the circuit board, or may simply abut to it. IEC-68-2-52 describes a salt-spray test for corrosion-resistant connectors, which is satisfied in the case of metal displacement. The connection arrangement according to the invention can be configured to pass a test according to IEC-68-2-52.

According to one exemplary embodiment of the first aspect of the invention, a plug element with high-current capable contact elements can therefore be provided which can even satisfy the high electrical requirements from the automotive domain without problems. The plug element can be directly inserted by hand into the corresponding (bore) holes of the circuit board by a human user, without a separate plug base being required between the plug element and circuit board, such as is the case in conventional high-current capable connection arrangements. At the same time, in spite of the simple and intuitive insertion of the plug element directly into the circuit board, a high vibration robustness may be guaranteed by the fact that a rigid mechanical safeguard is provided, which reliably prevents an unintentional withdrawal of the plug element from the circuit board in the inserted condition, for example caused by high vibrational forces. By a separate provision of the vibration-robust mechanical safeguard on the one hand and the high-current capable manually pluggable contact elements on the other hand, the seemingly contradictory requirements of being able to allow insertion and disconnection by a user with little force and hence by hand, and at the same time enabling to operate the arrangement of plug element and circuit board even in robust external conditions without adversely affecting the functioning, are satisfied. By a functional and structural separation of the vibration security provision from the high current contacting, a reversible, i.e. repeated attachment and detachment between plug element and circuit board is allowed without a possibility that a plastic deformation or the like of the plug or contact elements occurs. Relative to conventional high-current capable connection arrangements, a direct plug arrangement according to the invention may save having separate plug bases, which leads to advantages in terms of space savings and costs, and electrical losses or signal distortions are reduced or eliminated due to a shortened transmission path or the elimination of the contact site. Relative to conventional low current systems such as EP 1,069,651 A1 the invention represents a paradigm shift, since the simultaneous satisfaction of high current carrying capacity and vibration resilience requirements with the architecture used there is impossible and in addition, in the case of simultaneous contacting of multiple contact elements, manual operability is not permitted. In contrast, according to the invention, a high-current capable direct plug-in technique for the direct attachment of circuit boards on a plug element may be achieved without the provision of plug bases or the like, so that apart from any optional soldered components and possible purely mechanical fixing elements, only the circuit board itself is now required. Therefore, a high electrical current carrying capacity can be combined with a high mechanical strength and thus a high retaining force, which may be achievable for example by an easily lockable and unlockable mechanical safeguard system. Only by means of this additional mechanical locking mechanism, which can be provided on the plug element and/or the circuit board, the mentioned effects are in combination achievable.

Afterwards additional advantageous configurations of the connection arrangement of the first aspect of the invention are described. These configurations also apply to the plug element of the first aspect, to the vehicle of the first aspect, to the use of the first aspect and to a second aspect of the invention described below. Even though these configurations are described with respect to multiple contact elements, it is expressly emphasized that each of these configurations may also be employed with the provision of exactly one contact element. The provision of exactly one (through) hole in the circuit board, corresponding to exactly one contact element, is also possible.

The connection arrangement according to the invention or a plug element according to an embodiment of the invention can be particularly advantageously deployed for automotive applications, which means in powered vehicles of all types, combine harvesters, road building machines, vehicle engineering, railway engineering, aerospace engineering, harvesting machine engineering or in other areas of off-road vehicles or agriculture. The high-current capability of the connection arrangement may allow currents of 5 to 25 Amperes and more to pass per individual pin of the contact elements, and in fact upon application of a vibrational load. Therefore, the connection arrangement can be advantageously configured as an automotive connection arrangement. According to an embodiment of the invention a use of a connection arrangement according to an embodiment for transmitting an electric current of at least 5 Amperes, in particular of at least 10 Amperes, further in particular of at least 20 Amperes, between a contact element of the plug connector and the circuit board attached thereto.

According to one exemplary embodiment a locking mechanism, or in more general terms a mechanical safeguard mechanism, can be provided by the plug body. According to another exemplary embodiment, such a locking mechanism (implemented for example as a barbed hook or by other means) may be provided on the circuit board side. According to the invention, owing to the elimination of a base and a consequent direct plug insertion between circuit board and plug element material can be saved, an electrical interface can be eliminated and therefore a better quality can be obtained at lower cost. In particular electrical components, such as for example cable harnesses, can be flange-mounted directly on the circuit board. Overall, with the connection arrangement a current carrying capacity of for example 70 to 100 Amperes, in particular up to 150 Amperes and more, can be obtained. Per contact element for example, a current load of 10 to 15 Amperes can be carried, for example via a battery feed.

The contact elements or pins can be elastically and reversibly pluggable and for example insertable with forces of a maximum of 10 Newton. A reliable contacting to the opposing contact provided on the hole side can therefore be obtained and a good handling capability can be realized. For example the connection arrangement according to the invention is suitable for automotive applications, for example for tractors or buses, wherein according to the invention a mechanical fixing of the plug and the board by means of the mechanical safeguard can occur separately from the electrical transmission to the board. Connections of this type can transmit high currents and withstand high mechanical stresses. At the same time they can be manually pluggable many times. Therefore, high attachment forces with low insertion and withdrawal forces can be achieved, for example, if a tractor is to be repaired by a user in the field. If the contact elements have a defined distance relative to each other, the plug according to the invention can be standardized and thereby can be made usable for many applications.

In the connection arrangement the plurality of pluggable contact elements can be arranged running parallel to one another. Thereby a linear, space-saving geometry may be achieved, which simultaneously facilitates a contacting of many individual contacts to corresponding opposing parts on a circuit board. Multiple such series of contact elements can be combined, for example arranged parallel to one another. Alternatively to such a geometry however, for example, a two-dimensional, for example matrix-shaped, plug connection is also possible, in which contact elements can be arranged in rows and columns. By such an ordered structure also a standardizable plug connector may be created, which is then suitable for many applications.

The connection arrangement can be equipped with a positioning aid for aligning the plug elements relative to the circuit board immediately before plugging in the contact elements. Such a positioning aid can intuitively facilitate for a user to perform the insertion between plug element and circuit board in the correct manner and thus to avoid electrical malfunctions.

The connection arrangement can be fitted with a stop for limiting the insertion of the contact elements into the circuit board. Such a stop or spacer can define a minimum distance between circuit board and plug element, and therefore for example prevent the formation of undesired electrical contacts or an electrical signal jumping across a narrow gap.

All contact elements of the plug element can be identically adapted and identically arranged. By means of this measure a standard plug can be provided, which on the opposing side can be combined with a correspondingly standardized circuit board system.

In the connection arrangement the contact elements can be adapted to be flexible, at least in the regions to be arranged inside the plated-through hole, in a direction transverse to the insertion direction. Put another way, when inserting the contact elements into the associated holes of the circuit board a force can act on the contact elements, which urges them into the contact holes. Thus, the contact elements can be subjected to a slight pre-tension, when they poke into the contact hole. Due to this pre-tension a secure electrical contacting to the opposing contacts in the interior of the hole can be facilitated. At the same time such contact forces, which must first be overcome by the user during insertion, should be small enough so as not to impair mechanical handling capability during simultaneous insertion of multiple such contacts by a user, which means not to allow the insertion forces to become too great. In addition the deflection characteristics of the contact elements, configured for example in a spring like manner, can be designed to be reversible, that is, when removing the plug element from the circuit board they are caused to spring back elastically. Thereby, the plug element can be used repeatedly and is not destroyed by a single usage. A plastic deformation can be avoided by the flexible adaptation of the contact elements and by the provision of the contact elements as two curved spring elements spaced apart from each other.

Consequently it is preferred, when the contact elements comprise two legs leaving an intervening space between them. Their outer sides which face away from each other can optionally be designed for example with a convex curvature. Due to such a curvature an undesired splaying of the legs can be avoided during contact with a plane face. When tuning-fork contacts are used an elastic insertion capability can be achieved.

In the inserted condition of the contact elements the two legs can begin in front of the circuit board. A sub-region of the legs can remain outside of the hole, even if the plug element and the circuit board are plugged into each other.

The plug element can be a plug arranged on the end of one or more cables, in particular a plug connector of a cable harness. A cable harness can be understood as a bundle of individual cable leads, which transmit signals and/or operating currents. According to the invention it is possible to employ such cable harnesses as parts of automotive systems, which means in vehicle engineering, or in mechanical engineering.

The plug element can be arranged on a housing containing an electronic component, for example a relay or a fuse. Alternatively however, a housing-free configuration of the plug element is also possible, in which this is provided only in the form of a sheet metal element (which can be electrically insulated for example with a lacquer, in order to protect a user against high currents).

The plug element can form a part of a holder for an electronic component, for example a relay or a fuse. Such an electrical component can therefore be fixed to the plug element, designed as a holder.

According to one exemplary embodiment, all contact elements of a plug element can be produced integrally from a single piece of sheet metal by punching and bending. Such an integral design of the plug element from one piece of sheet metal results in particularly low costs. Alternatively however, a plug element can also be formed from multiple components, for example in order to integrate other functions.

The mechanical safeguard of the plug element and the circuit board can be connected with a mechanical loading capacity according to ISO 16750-3 (in particular in the ISO 16750-3:2007 version). Put another way, the mechanical safeguard can be configured in such a manner that an appropriately configured connection arrangement can successfully pass the tests defined in ISO 16750, in particular in ISO 16750-3, (in the version valid on the submission date of the European patent application EP 09163009.5, i.e. Jun. 17, 2009).

The configuration of devices according to the invention can be carried out in accordance with ISO 16750, in particular in the versions in ISO 16750-1:2006, ISO 16750-2:2006, ISO 16750-3:2007, ISO 16750-4:2006 and ISO 16750-5:2003.

For example, the mechanical safeguard can connect the plug element and the circuit board with a mechanical fixing force of at least approximately 100 Newton, in particular of at least approximately 200 Newton, further in particular of at least approximately 300 Newton. Such fixing forces can be sufficient to facilitate an adequate level of vibration resilience.

The holes and the contact elements that can be plugged into them can provide an electrical loading capacity according to ISO 16750-2 (in the version valid on the submission date of the European patent application EP 09163009.5, i.e. on 17 Jun. 2009). The holes and the contact elements that can be inserted into them can in particular have an electrical loading capacity according to ISO 16750-2 in the ISO 16750-2:2006 version. Put another way, the contact elements can be mechanically and electrically configured such that the electrical stress tests according to the cited industrial standard can be successfully passed.

In particular, each of the pluggable contact elements can be designed for an electrical loading capacity of at least approximately 5 Amperes, in particular of at least approximately 10 Amperes, further in particular of at least approximately 20 Amperes. If multiple pins are provided (that can be operated so that they are electrically insulated from each other), a total current carrying capacity of for example 70 Amperes and more can therefore be achieved.

Each of the pluggable contact elements can be adapted to be inserted into one of the holes with an insertion force of maximally approximately 10 Newton. Therefore, when for example five contact elements are provided, which are to be inserted simultaneously into a circuit board by a user, an insertion force of 50 Newton can be required, which a user can still exert without a problem.

According to one exemplary embodiment the mechanical safeguard and the pluggable contact elements are provided as components that are separated from each other and separately mounted on the plug element. In other words, a mechanical safeguard component and the pluggable contact elements can be free of any direct and immediate mechanical adjacency to each other and can also be electrically decoupled from each other. By the complete separation of the mechanical and electrical contacting the seemingly a priori contradictory requirements of low insertion force in combination with a high retaining force are in fact achieved.

According to an exemplary embodiment, the mechanical safeguard and/or the pluggable contact elements and/or the stop can be provided as components mounted jointly on the plug element. In particular, exactly two of these three components (mechanical safeguard, contact elements, stop) can be realized as a common physical structure, in particular contact elements and stop or safeguard and stop. By aggregating multiple functional components to form a single common structure, a dimension of the plug element can be kept small. The mechanical safeguard and pluggable contact elements can however preferably be designed as separate components, in order to achieve a separation between high-current capable electrical coupling and vibration-stable fixing.

The plug element can be fitted with the mechanical safeguard against unintentional withdrawal of the plug element from the circuit board. In this configuration the plug element alone can comprise a structure with which the safeguard is accomplished (for example a fixing lever, a male locking part with barbed hooks, etc.). In such a configuration the circuit board can be completely free of safeguard elements, or can have only one receiving bore for receiving a safeguard of the plug element or can have a surface, onto which a safeguard of the plug element can engage.

Alternatively, the circuit board can be fitted with the mechanical safeguard. In this configuration the circuit board alone can have a structure with which the safeguard is accomplished (for example a fixing lever, a male locking part with barbed hooks, etc.). In such a configuration the plug element can be completely free of safeguard elements, or can just have a receiving bore for receiving a safeguard of the circuit board or can have a surface onto which a safeguard of the circuit board can engage.

It is also possible that both the circuit board and the plug element each comprise a structural component which serves as a safeguard.

A surface of the circuit board that is free of the plated-through holes can be provided with a module protective feature. In particular this surface can be coated or cast with protective material (for example a lacquer or an encapsulation volume). Conventionally, modules are often protected mechanically by a housing, or chemically by thin layers of lacquer coating. A complete casting of a module as an alternative to coating the housing is often laborious when done conventionally and therefore uneconomically, because with the conventional provision of plug bases between circuit board and plug element it is often necessary to take a three-dimensional contour (through the mounted components and in particular the plug base) into account. With the application of the direct plug-in technique according to the invention, a simplified module protection is possible, since now only a two-dimensional coating task remains. Namely, the circuit board can be essentially flat and can comprise only the holes and their contacting areas. At most, flat soldered components can be present on it. In other words, with the direct plug-in technology it is also possible to economize on entire housings (and the necessary tools), by having the modules cast or coated, and thus completely mechanically or chemically protected. While conventionally an expensive masking of three-dimensional components before casting or lacquering a 3D surface or a elaborate selective coating process is necessary, according to the invention the area of the plated-through holes and the contactings contained therein could be covered with a simple mask and a complete remaining surface section of the conductor paths could be sprayed with a lacquer coating or provided with a casting. A corresponding method for forming a module protection is provided according to the invention.

According to an exemplary embodiment at least one additional hole of the circuit board can be provided, which is covered, in particular coated or cast, with the module protective material. For example, holes which are not to be mounted with components and/or holes which are provided for forming solder connections can be covered by module protective material.

In order to enhance the applicability of the connection arrangement according to the invention in particular for vibration-susceptible and high current demanding automotive applications and the like, in addition to or alternatively to the satisfaction of the above mentioned industrial standards, the connection arrangement can also be configured in such a manner that it is compatible with the IEC-60512-6 (rapid temperature cycling according to the insertion standard), in particular also compliant with IEC-68-2-14 (dry heat). It is also possible that the connection arrangement is designed in accordance with tests in different climatic conditions according to insertion standards IEC-60512-6 and IEC-60512-11-1 (on this point, cf. in particular IEC 68-2-1 (coldness), IEC 68-2-2 (dry heat) and IEC 68-2-30 (damp heat, cyclic)). The connection arrangement can also be designed in accordance with an industrial climate test according to IEC 60512-11-7 (IEC 68-2-52 (salt spray, cyclic) or IEC 68-2-60 (corrosive gas ($H_2S$, $NO_2$, $SO_2$).

The high-current capable contact elements can be produced in particular from copper, aluminum, silver, gold or alloys, such as for example brass or bronze. The ohmic resistance of such a contact element can be in the range between 10 μΩ and 10 mΩ, preferably between 100 μΩ and 1 mΩ. A length of the contact elements through which the electrical current flows can lie in a range between 1 mm and 100 mm, preferably between 2 mm and 50 mm. A thickness of the contact elements through which the electrical current flows can lie in a range between 0.1 mm and 6 mm, preferably between 0.5 mm and 3 mm. A cross-sectional area of the contact elements can lie in a range between 0.01 $mm^2$ and 30 $mm^2$, preferably between 0.2 $mm^2$ and 25 $mm^2$. The vibration-robust mechanical safeguard can be produced from one of the following materials: steel, hard plastic, copper, aluminum, silver, gold or alloys such as for example brass or bronze. The vibration-robust mechanical safeguard can be configured to withstand vibrational forces as in the standards cited above.

The contact elements in the connection arrangement can be configured as crimp contacts. Using a crimp connection a stable, flexible connection to a wire or cable can be implemented at reasonable effort. Crimping is understood to mean a joining method in which two components are connected together by plastic deformation.

The crimp contacts can comprise a crimp-capable crimp section (for attaching a wire or cable) and an elastically pluggable section (for directly plugging onto a circuit board).

The crimp-capable crimp section and the elastically pluggable section can be formed from different materials. The crimp-capable crimp section can be formed with a thinner material thickness than the elastically pluggable section. Thus, it is possible, on one hand due to the provision of a sufficiently thin piece of material (for example with a thickness of 0.4 mm, for example of bronze), to obtain both a good crimp connection, and on the other hand with a thicker material (for example with a thickness of 0.8 mm, for example of K55 or K88) to obtain a good elasticity with high current-carrying capacity. It is advantageous, if the contact is composed of two different regions:

- a region consisting of bronze for the crimping zone with a thickness of 0.4 mm
- a region consisting of K55 or K88 for the plug zone with a thickness of 0.8 mm.

The plug zone is thicker due to the required mechanical stability and the current transmission in the via of the circuit board.

The vibration-robust mechanical safeguard can be adapted as at least one locking clip, which can be configured to engage in a correspondingly designed lock receiving opening of the circuit board. Thereby, the plug can be inserted into the board and locked in an easily manageable manner. A tolerance compensation of the circuit board thickness may be achieved by deep milling on the underside of the circuit board.

Alternatively or in addition, the vibration-robust mechanical safeguard can be adapted as at least one screw element, which can be configured to engage in a correspondingly designed threaded sleeve of the circuit board. The threaded sleeves can be screwed to the circuit board. Thickness tolerances of the circuit boards can be compensated via the screw insertion depth.

Alternatively or in addition the vibration-robust mechanical safeguard can be adapted as at least one expanding rivet, which is configured to engage in a correspondingly designed rivet receiving opening in the circuit board. Thereby, a rivet bolt can be pressed in and spread by variable amounts. Tolerances in the circuit board thickness can be compensated for. An active and an inactive expanding rivet can be provided, in order to increase the handling capability.

In the connection arrangement the contact elements (in particular in combination with the circuit board) can be configured so that when plugging the contact elements by hand into the holes the contact elements are only (or exclusively) deformed in the elastic range. Thus, when plugging in the contact by hand, the contact spring can actually also be deformed only in the elastic range. The elastic range can be regarded as the range in which the deflection and restoring force are directly proportional to each other. As elastic range it can be regarded the range in which no plastic deformation occurs.

In the following a second aspect of the invention is described. In particular, additional sub-aspects of the second aspect of the invention will also be described in the following. These also apply to the connection arrangement of the first aspect, the plug element of the first aspect, the vehicle of the first aspect and the use of the first aspect.

1st sub-aspect: Connection arrangement on circuit boards (28), with 1.1 a plug element, which 1.2 comprises a plurality of pluggable contact elements (5) extending parallel to one another (for example with Hookean characteristics), and with 1.3 a circuit board (28) with plated-through holes, 1.4 which are arranged in an arrangement corresponding to the arrangement of the contact elements (5) of the plug element, wherein 1.5 the holes and the contact elements (5) pluggable into them are matched to each other in such a manner that 1.6 the plug element can be manually connected to the circuit board (28) by inserting the contact elements (5) into the holes and can be removed manually.

2nd sub-aspect: the connection arrangement according to sub-aspect 1, with a mechanical safeguard against unintentional withdrawal of the plug element from the circuit board (28).

3rd sub-aspect: the connection arrangement according to sub-aspect 1 or 2, with a positioning aid (7) for aligning the plug element relative to the circuit board (28) immediately before plugging in the contact elements (5).

4th sub-aspect: the connection arrangement according to one of the preceding sub-aspects, with a stop (6) for limiting the insertion of the contact elements (5) into the circuit board (28).

5th sub-aspect: the connection arrangement according to one of the preceding sub-aspects, in which all contact elements (5) of a plug element are identically adapted and identically arranged.

6th sub-aspect: the connection arrangement according to one of the preceding sub-aspects, in which at least in the region to be arranged inside the plated-through holes, the contact elements (5) are flexible in a direction transversely to the insertion direction.

7th sub-aspect: the connection arrangement according to one of the preceding sub-aspects, in which the contact elements (5) comprise two legs (16) leaving an intervening space (17) between each other, the outer sides (20) of which, facing away from each other, are optionally adapted convexly curved.

8th sub-aspect: the connection arrangement according to sub-aspect 7, in which in the inserted condition of the contact elements (5) the two legs (16) begin in front of the circuit board (28).

9th sub-aspect: the connection arrangement according to one of the preceding sub-aspects, in which the plug element is a plug arranged on the end of one or more cables (23), in particular a plug connector of a cable harness.

10th sub-aspect: the connection arrangement according to one of the sub-aspects 1 to 8, in which the plug element is arranged on a housing (30) containing an electronic and/or an electronic component, for example a relay or a fuse.

11th sub-aspect: the connection arrangement according to one of the sub-aspects 1 to 8, in which the plug element forms a part of a holder for an electronic and/or electronic component, for example a relay or a fuse.

12th sub-aspect: the connection arrangement according to one of the preceding sub-aspects, in which all contact elements (5) of a plug element are produced integrally from a single piece of sheet metal by punching and bending.

13th sub-aspect: a plug element for a connection arrangement according to one of the preceding sub-aspects, containing a plurality of identically adapted and identically arranged pluggable contact elements (5) running parallel to one another.

14th sub-aspect: use of a plug element according to sub-aspect 13 for repeated production of plug connections to circuit boards (28).

According to the second aspect, the invention therefore provides that a plug element is directly plugged into the plated-through holes of a circuit board with its contact elements, wherein the tolerances of the plated-through holes and the contact elements are matched to each other in such a manner that this insertion can manually be executed by a person, even if the plug element comprises a plurality of contact elements. This person has then also be able to remove the plug again. This does therefore not involve pressing in the contact elements into plated-through holes, for which a machine is required. Pressing in the contact elements is a procedure to be executed only once, which cannot be repeated. In particular, a repeated connection over many cycles is not possible in this case.

To press in the contact elements, forces in the range of approximately 15 to 250 Newton are required. During plugging, as is proposed according to the second aspect of the invention, the forces lie in the range of approximately 0.1 to 10 Newton.

While, when contact elements are pressed into circuit boards, the retaining forces are so large that unintentional detachment cannot occur, this can sometimes occur with the connection arrangement proposed according to the second aspect of the invention.

According to the invention it can be provided that the connection arrangement comprises a mechanical safeguard to protect against unintentional withdrawal of the plug element from the circuit board. This mechanical safeguard can be constructed in different ways. It can be arranged both on the circuit board and on the plug element, preferably consists of parts that are arranged in a plug element, and of parts that are arranged on the circuit board. The parts of a mechanical safeguard can also include a hole.

In the previously known solutions a socket or plug sleeve can represent or form an alignment device for the plug. Since such a socket of the plug sleeve is no longer present in the connection arrangement according to the second aspect of the invention, according to the invention an extension can be provided in which an additional positioning aid is provided, in order to ensure that the contact elements mate with the associated plated-through holes.

It has proven particularly reasonable and favorable, if a positioning aid simultaneously also comprises or forms the mechanical safeguard.

According to the invention the plug element can comprise a plurality of individual pluggable contact elements, which are simultaneously plugged into their associated holes in one insertion process. When these pluggable contact elements are arranged for example on the underside of a housing, and the housing should not necessarily touch the circuit board, for whatever reasons, according to the invention the plug element can comprise a stop, in order to limit the insertion.

Such a stop limiting the insertion can also be constructed on the housing itself.

The contact elements constructed on the plug element are assigned to specific plated-through holes of the circuit board. It is possible that these holes have different diameters, so that also differently sized or differently shaped contact elements can be present on a plug element. It has turned out to be particularly reasonable however, if all contact elements of the plug element are identically adapted and identically arranged.

In order to achieve the properties mentioned above, namely the possibility of manual insertion of the contact elements into the holes, in an extension of the invention according to the second aspect it can be provided that the contact elements are designed to be flexible or springy in the direction transverse to their insertion direction. The spring constant can be varied over a wide range by appropriate choice of materials and geometrical design of the contact elements.

A particularly reasonable design of the contact elements is obtained, when the contact elements, at least in the region in which they are arranged inside the through holes after insertion, comprise two legs with an intervening space left between them. The intervening space between the legs ensures that the legs can be bent inwards in the direction transverse to the insertion direction.

This leads to the aforementioned flexibility of the contact elements in a direction transverse to the insertion direction.

In order to make the insertion easier according to an extension of the invention, it can be provided that the outwardly directed faces of the legs facing away from each other run in a convexly rounded manner, when viewed perpendicular to the insertion direction. In a cross-section transverse to the insertion direction by contrast, the outwardly directed faces of the legs can be adapted to be linear.

In order to adapt the flexibility of the contact elements in a wide scope, according to the invention, it can be provided that the legs already begin in front of the circuit board, or in other words, that the intervening space between the legs in the inserted condition of the contact elements on the side of the plug element extends up the front face of the circuit board. For example, the legs and the intervening space formed between them can be designed so that about two thirds of the length of the legs is arranged in the plated-through hole, while one third of the length of the legs still lies outside the circuit board. When the contact elements are arranged on a housing and lie completely outside of the housing, the above mentioned stop can ensure that the contact elements are only inserted into the plated-through hole up to a certain part of the length of their legs.

As an example for what the invention according to the second aspect can be used for, it can be provided that the plug element is a plug arranged on the end of one or more cables. If this is a power cable, then for example multiple contact elements can be connected to the same cable. It can also be the case however that, if multiple cables are connected to one plug, each contact element is connected to another cable.

A further example of a plug element consists in that the plug element is arranged on a housing in which one or more electrical and/or electronic components are accommodated, such as a relay, for example.

It is also possible that the plug element forms a holder for an electrical and/or electronic component, for example a melting fuse, which is clamped between two holder. Also, a battery holder can be formed by two plug elements.

For manufacturing a plug element it can be provided as an extension that all contact elements of a plug element, and optionally also the entire plug element, are produced integrally from a single piece of sheet metal by punching and optionally bending.

The invention according to the second aspect also proposes a plug element with a plurality of contact elements, wherein the plug element has one or more features as are described herein. The contact elements can have one or more of the features of the contact elements, which have been described herein.

The invention according to the second aspect also proposes the use of a plug element such as has been described herein for producing a connection to a circuit board in the manner described herein.

Further features, details and preferences of the aspects of the invention follow from the claims and the abstract, the wording of both of which is incorporated by reference into the content of the description, from the following description of preferred embodiments of the invention as well as from the drawing. The features described in one embodiment should also apply in the other embodiments.

BRIEF DESCRIPTION OF THE DRAWINGS

The invention will be described in more detail hereinafter with reference to examples of embodiments but to which the invention is not limited.

DETAILED DESCRIPTION

Below, plug elements and connection arrangements according to exemplary embodiments of the invention are described by referring to FIG. 1 to FIG. 13.

Figure 1:
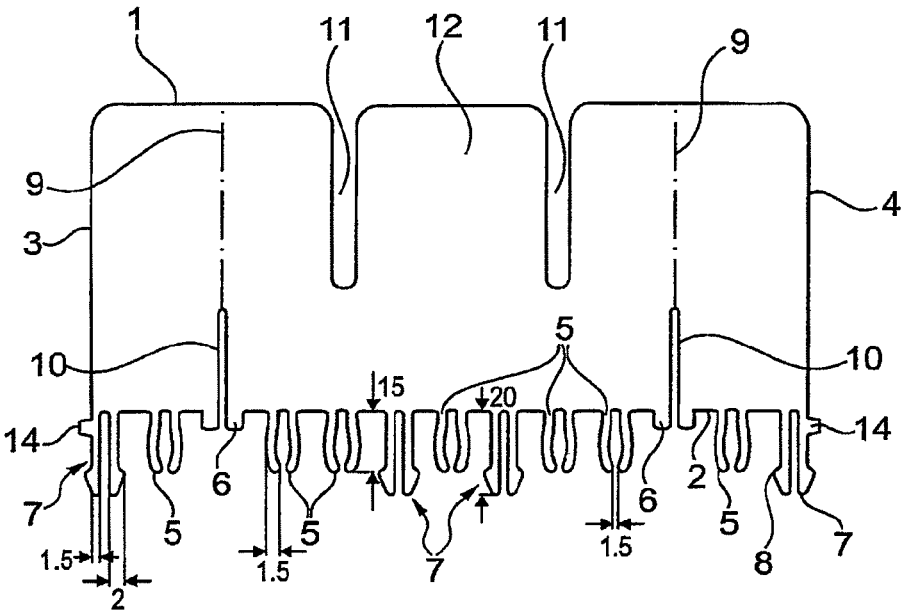
FIG. 1 includes a high-current capable and vibration-robust plug element according to an exemplary embodiment of the first aspect of the invention before the final fabrication.

FIG. 1 shows a plug element for such a connection arrangement with a total of seven pluggable and respectively high-current capable contact elements 5. These are mountable on a circuit board, not shown in FIG. 1, with plated-through holes. These holes are applied in a geometrical arrangement, which corresponds to an arrangement of the contact element 5 of the plug element according to FIG. 1. Thus, the holes and the contact elements 5 pluggable into them are matched to one another. Due to the dimension according to FIG. 1 (which are given in millimeters) and to the construction of these conducting structures from low-resistance copper material, the contact elements 5 are high-current capable, which means they are configured to conduct a current of at least 10 Amperes. The plug element can be manually connected by plugging the contact elements 5 into the holes of the circuit board, and manually removed. To do so, a maximum force of 10 Newtons per contact element 5 is sufficient.

Due to the dimensioning, the material configuration and the mechanical robustness of the mechanical safeguard elements 7, the plug element according to FIG. 1 is vibration-robust and in particular satisfies the requirements of industrial standard ISO 16750-3. The mechanical safeguard elements 7 prevent an unintentional withdrawal of the plug element 5 from the circuit board and also protect against an unwanted release of the electrical contacting between the contact elements 5 and the contacting in the holes of the circuit board, even if the plug element according to FIG. 1 and the associated circuit board are implemented in an agricultural vehicle, which has to withstand vibrations of the engine and vibrations due to the movement of this vehicle on an uneven terrain.

According to FIG. 1 the mechanical safeguard elements 7 are provided as mechanical components separate relative to the contact elements 5, which enables a low-force manual insertion and at the same time a vibration-proof attachment. The arrangement of the safeguard elements 7 also serves as a positioning aid for the correct alignment of the plug element relative to the circuit board before the contact elements 5 are plugged into the holes, so that an improper insertion can be avoided.

Stops 6, which according to the exemplary embodiment shown are provided separately from the contact elements 5 and the mechanical safeguard elements 7, limit the insertion of the contact elements 5 into the circuit board. All components of the plug element according to FIG. 1 are produced integrally from a single sheet of metal by punching and bending, wherein the metal sheet has a thickness of at least 2 mm, preferably of at least 3 mm.

The sheet metal blank according to FIG. 1 contains an upper edge 1 and a oppositely arranged lower edge 2. Both edges 1, 2 are arranged parallel to each other. To the right and left the plug element is bounded by a side edge 3, 4. On the lower edge 2 associated to the circuit board the contact elements 5 are constructed, which extend downwards over the lower edge 2 and run parallel to each other. The safeguard elements 7 have barbed hooks 14 on their outer sides. Parallel to the side edges 3, 4 the sheet metal blank comprises bending lines 9, in the extension of which narrow slits 10 are arranged. Slits 10 are intended to make bending easier. In the central part, two slits 11 are formed, starting from the upper edge 1. Thereby, between the two slits 11 a tongue 12 is formed, which is bent slightly inwards, that is to say in the direction in between the two outer wings (similarly as shown with reference number 13 in FIG. 14).

Figure 2:
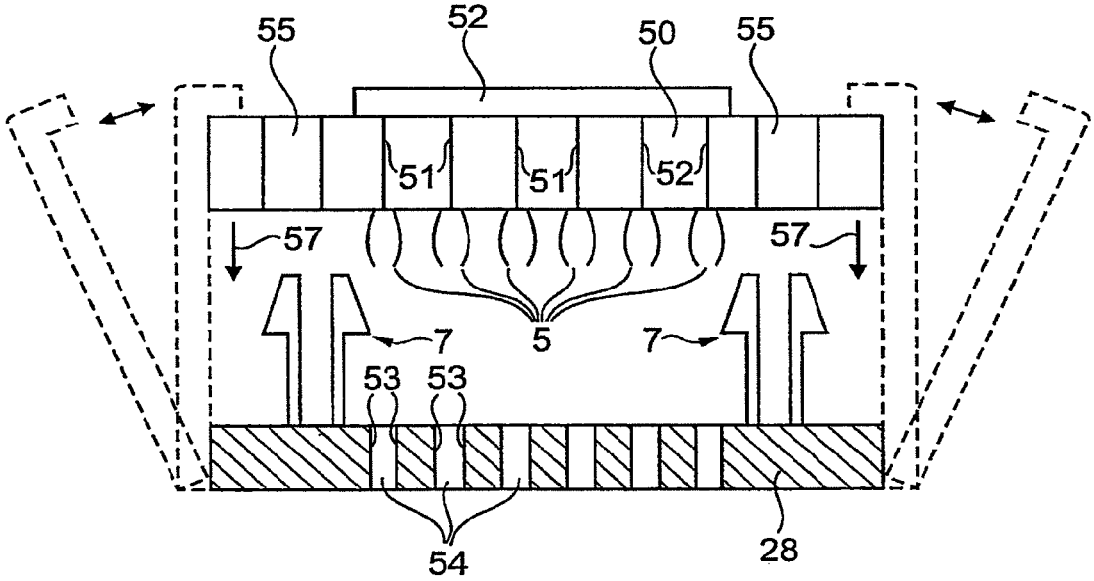
FIG. 2 includes a high-current capable and vibration-robust connection arrangement according to an exemplary embodiment of the first aspect of the invention.

FIG. 2 shows a connection arrangement according to another exemplary embodiment of the invention.

FIG. 2 shows a substrate 50, on the underside of which the contact elements 5 are provided, which are connected by means of plated-through holes 51 to an upper side of the substrate 50. As indicated in FIG. 2 schematically with reference number 52, an electrical peripheral device can be connected here, which either applies electrical currents via the contacting elements 51, 5 to contacting areas 53 in holes 54 of a conductor path 28, or receives these signals from conductor path 28. Namely, when the plug element shown in FIG. 2 above is plugged into the circuit board 28 by movement in the direction of the arrow 57, the contact elements 5 are inserted into holes 54 of the circuit board 28 and automatically establish the electrical contact to the respective contacting element 53 inside the respective hole 54. Simultaneously, the vibration-robust mechanical safeguard elements 7 mounted on the circuit board 28 according to FIG. 2 are accommodated in corresponding grooves 55 in the substrate 50 of the plug element, whereby a secure locking results.

As indicated in FIG. 2 in dashed lines, additionally or alternatively to the vibration-robust mechanical safeguards 7 manually pivotable clamping elements can be mounted on the circuit board 28, which can be pivoted laterally and can engage with an upper side of the substrate 50, in order to provide or to reinforce the vibration-robust mechanical safeguard.

Figure 3:
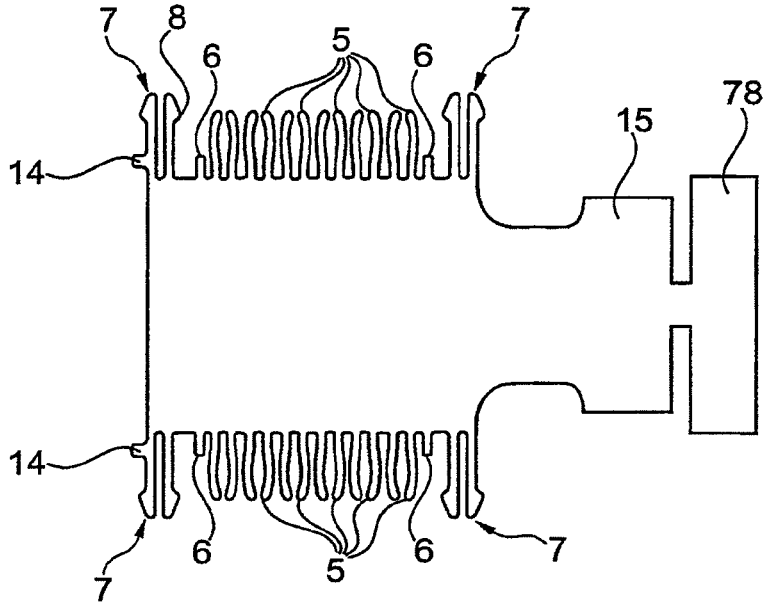
FIG. 3 schematically illustrates a metal blank for producing a high-current capable and vibration-robust plug element according to an exemplary embodiment of the first aspect of the invention.

FIG. 3 schematically shows a sheet metal blank, from which a high-current capable and vibration-robust plug element can be manufactured by bending, according to another exemplary embodiment of the invention. As in FIG. 1 also here the mechanical safeguard elements 7 are mounted on the plug element. Metal sections 78 and 15 serve to allow a cable to be passed around them and to be pressed from there. The sheet metal blank of FIG. 3 is bent in such a way that two rows of contact elements 5 run parallel to each other.

Figure 4:
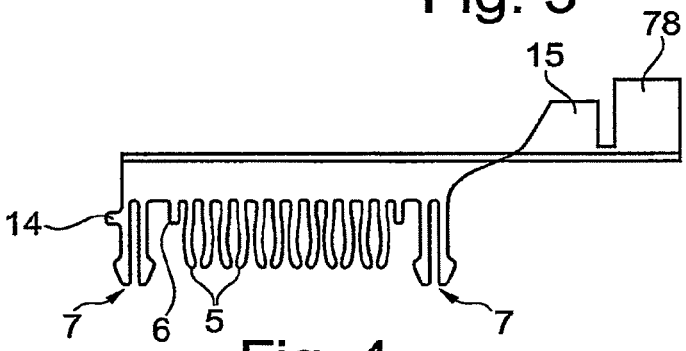
FIG. 4 schematically illustrates a side view of the plug element according to FIG. 3.
Figure 5:
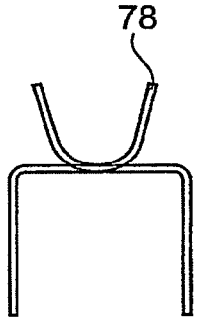
FIG. 5 includes the front view of the plug element of FIG. 4.

This is schematically shown from the side in FIG. 4. FIG. 5 shows the arrangement of the finished bent sheet metal element from the right in FIG. 4. The sheet metal parts 78 are bent upwards, so that a cable can be inserted there, which is then pressed together with the sheet metal blank.

Figure 6:
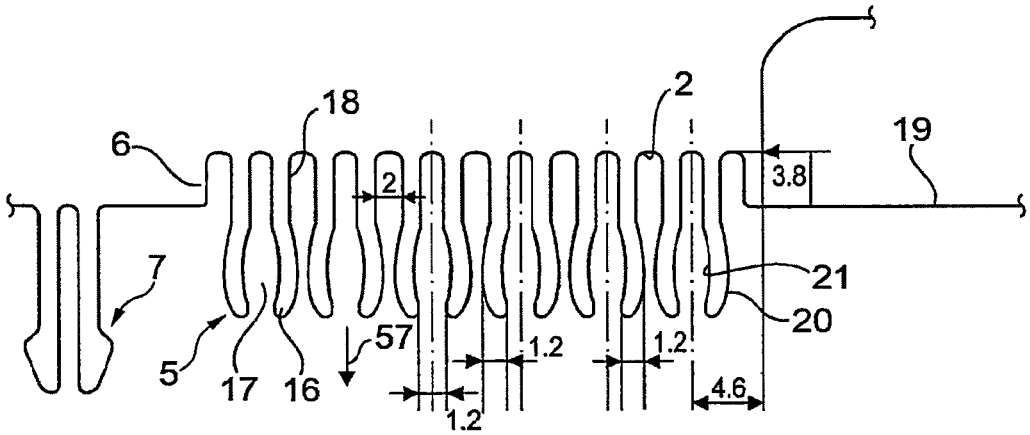
FIG. 6 illustrates in an enlarged scale, the arrangement of the contact elements in a high-current capable and vibration-robust plug element according to an exemplary embodiment of the first aspect of the invention.

FIG. 6 shows an enlarged illustration of a plug element according to an exemplary embodiment of the invention, wherein the applied dimensions in combination with the provision of the shown sheet metal, made of copper, are in accordance with the requirements of high-current capability and vibration resilience.

The contact elements 5 contain two legs 16, between which a slit 17 is formed. The legs 16 begin at the lower edge 2 of the plug element, at first with parallel side edges 18. A short distance below the mentioned surface plane 19, the outer edges 20 of the two legs facing away from each other are curved outwards in a convex manner. This shape is also followed by the inner sides 21 of the legs 16 that face each other. The ends of the legs 16 are spaced apart from each other by a distance. In this way the legs 16 of the contact elements 5 can deform inwards, i.e. in a direction that runs transversely to the insertion direction 57 of the contact elements 5.

Figure 7:
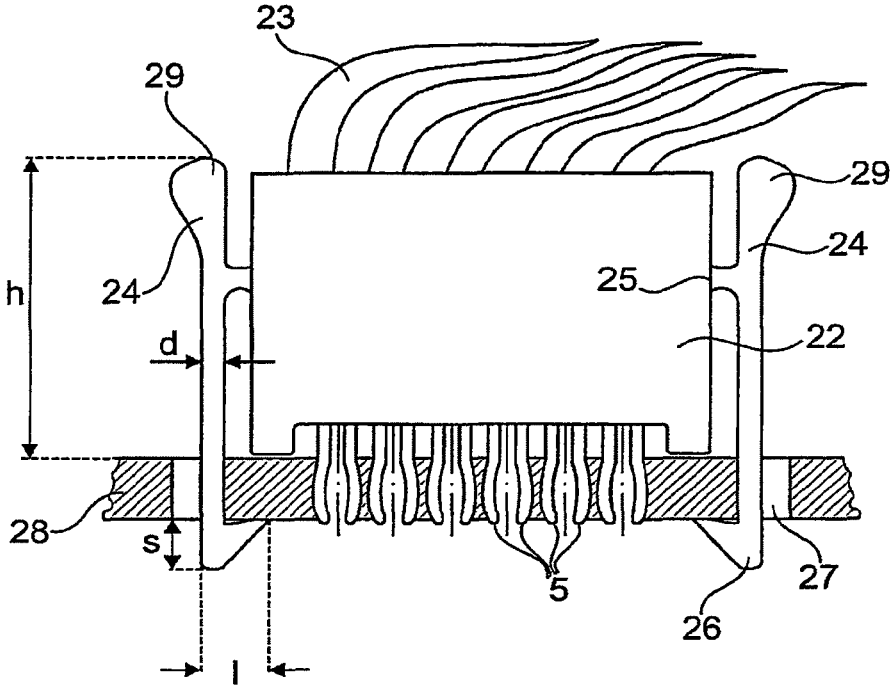
FIG. 7 schematically illustrates a plug as a high-current capable and vibration-robust plug element according to an exemplary embodiment of the first aspect of the invention.

While FIG. 1 shows a plug element that is used as part of a holder for a component, and FIG. 3 to FIG. 6 show plug elements that can be designed as plugs for a single cable, FIG. 7 shows a plug element in which the contact elements 5 protrude out of a housing 22. In the housing 22, connections with multiple cables 23 to the individual contact elements 5 are accommodated. This therefore represents a plug with a plurality of cables 23.

On the two sides of the housing 22 facing away from each other, metallic levers 24 (in particular composed of stainless steel) are formed, which can be tilted about the junction location 25. With their front ends 26 these levers 24 extend through the through holes 27 of the circuit board 28. At this end 26 each lever 24 is fitted with a barbed hook, which prevents from pulling out of the hole 27 of the circuit board 28. The two levers 24 are pre-tensioned into the position shown, in which the barbed hooks abut with the rear of the circuit board 28. In order to pull the plug out, the two levers 24 must be tilted such that the barbed hooks fit through the holes 27. The tilting can occur by pressing, at the end 29 facing away from the circuit board 28, the lever 24 is pressed inwards.

Figure 8:
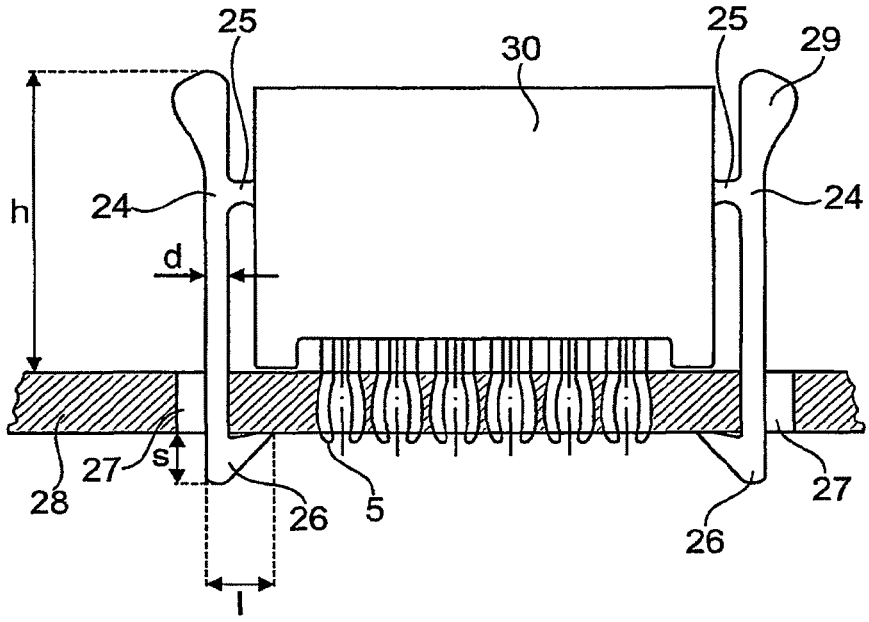
FIG. 8 includes the arrangement of a housing with high-current capable contact elements of a vibration-robust connection arrangement according to an exemplary embodiment of the first aspect of the invention.

FIG. 8 shows an exemplary embodiment in which a housing 30 is provided with a series of contact elements 5, which are constructed in the same way as in FIG. 7. Again, metallic levers 24 (in particular consisting of stainless steel) are formed on both sides of the housing 30, which have the same function as in the embodiment according to FIG. 7. Here, the contact elements 5 are in connection to electrical and/or electronic components inside the housing 30. These can be either simple or more complicated electronic components, also for example complete circuits.

Since the levers 24 with their front ends 26 considerably project beyond the front ends of the contact elements 5, and since the front ends are tapered to a point, these front ends of the levers 24 form a positioning aid by means of which the plug element can be aligned relative to the through holes 27 such that the contact elements 5 immediately find the through holes associated to them.

FIG. 7 and FIG. 8 show the following dimensional values: thickness d can be for example at least 3 mm, length l at least 4 mm and height h at least 30 mm, with which the required vibration resilience can be achieved.

Below, with reference to FIG. 9 to FIG. 11 an exemplary embodiment of the invention will be described, in which the circuit board 28 is covered with a module protective material, for example an electrically insulating and mechanically protective lacquer.

Figure 9:
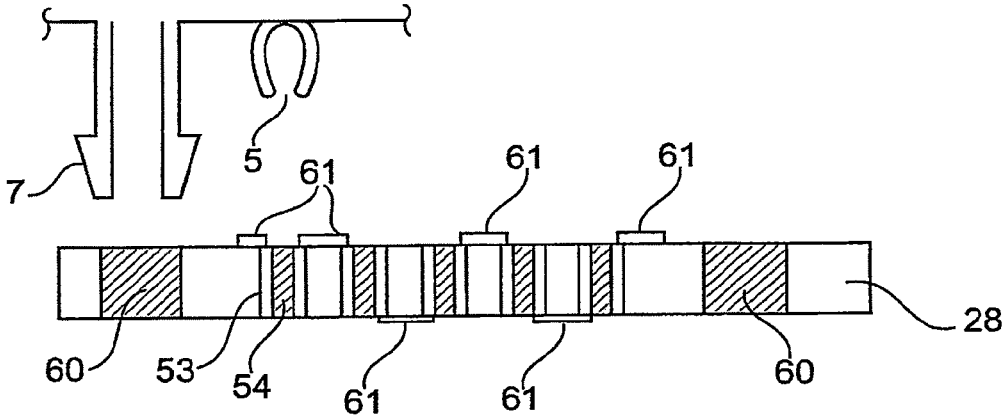
FIGS. 9 to 11 include a cross sectional view of a connection arrangement according to an exemplary embodiment of the first aspect of the invention and illustrate a method according to the invention for constructing a module protection.

FIG. 9 indicates how a safeguard element 7 and a contact element 5 of a plug element, otherwise not shown in detail, are arranged relative to the circuit board 28, namely in a manner such that safeguard elements 7 are flush with the corresponding securing holes 60 of the circuit board 28 and contact elements 5 are flush with holes 54. These are each provided in the inside with an electrically conductive contacting 53, in order to effect an electrically conductive connection to the respective contact element 5, when the contact elements 5 are inserted.

Further, in FIG. 9 is schematically indicated, cf. reference number 61, that on one or on both opposite main surfaces of the circuit board 28 this can have electrically conductive paths, by means of which individual plated-through hole contactings 53 or other components can be electrically coupled. FIG. 9 also shows that according to the invention no separate sockets (sleeves) need to be provided, which leads to a substantially planar surface of the conductor paths 28.

Figure 10:
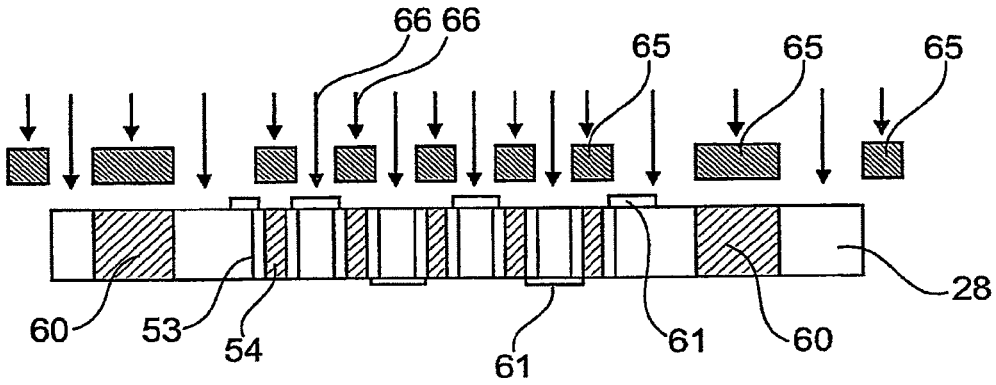

FIG. 10 shows that a mask 65 (for example a suitably structured or perforated thin plate) can be arranged on or above the conductor path 28, which is structured such that a subsequent areal coating of lacquer (for example by spraying, see reference number 66) includes the entire surface of the circuit board 28 and covers it with a lacquer layer 67, with the exception of the holes 54 and the plated-through contacting 53 provided thereon, and optionally the securing holes 60.

Figure 11:
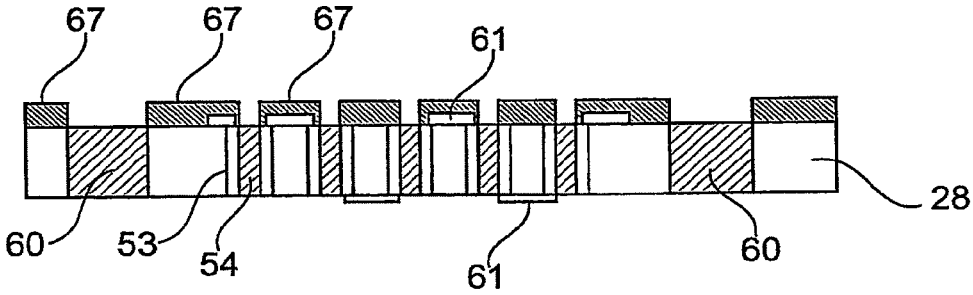

As shown in FIG. 11, thereby essentially the entire surface of the circuit board 28 can be coated with a flat two-dimensional lacquer layer 67, with the exception of the holes 54 and the plated-through contacting 53 provided thereon, and optionally the securing holes 60.

In a manner similar to that shown in FIG. 9 to FIG. 11, a mask-based casting of the circuit board 28 with a casting material can also be carried out.

Figure 12:
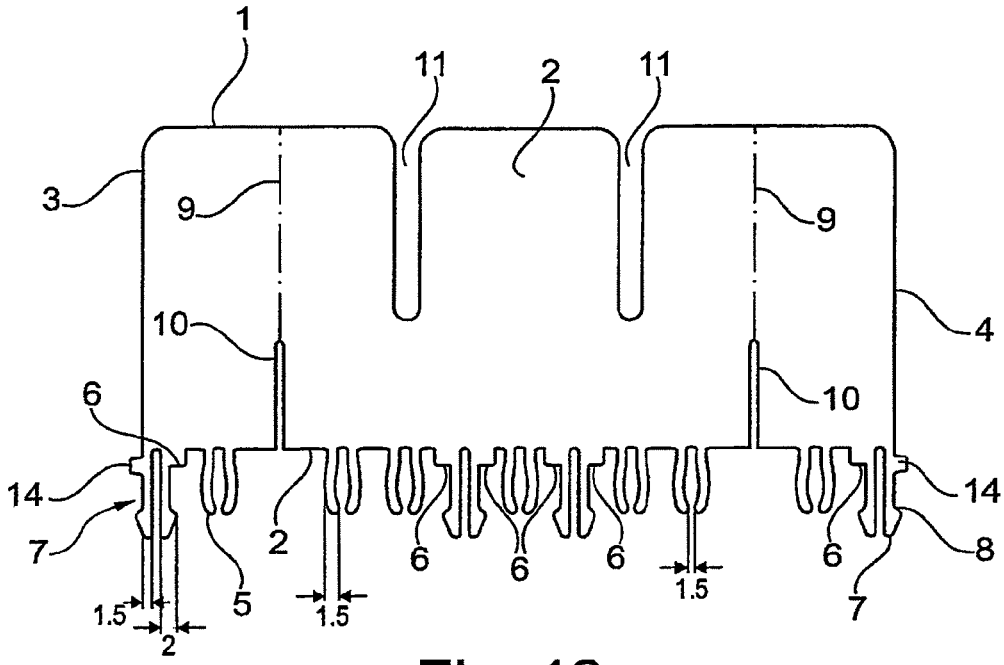
FIGS. 12, 13 illustrate plug elements according to other exemplary embodiments of the first aspect of the invention.

FIG. 12 shows a plug element according to another exemplary embodiment of the invention, which resembles FIG. 1, but in which the spacers 6 and the safeguard elements 7 are integrally provided, which means they have a common physical structure and are immediately adjacent to one another.

Figure 13:
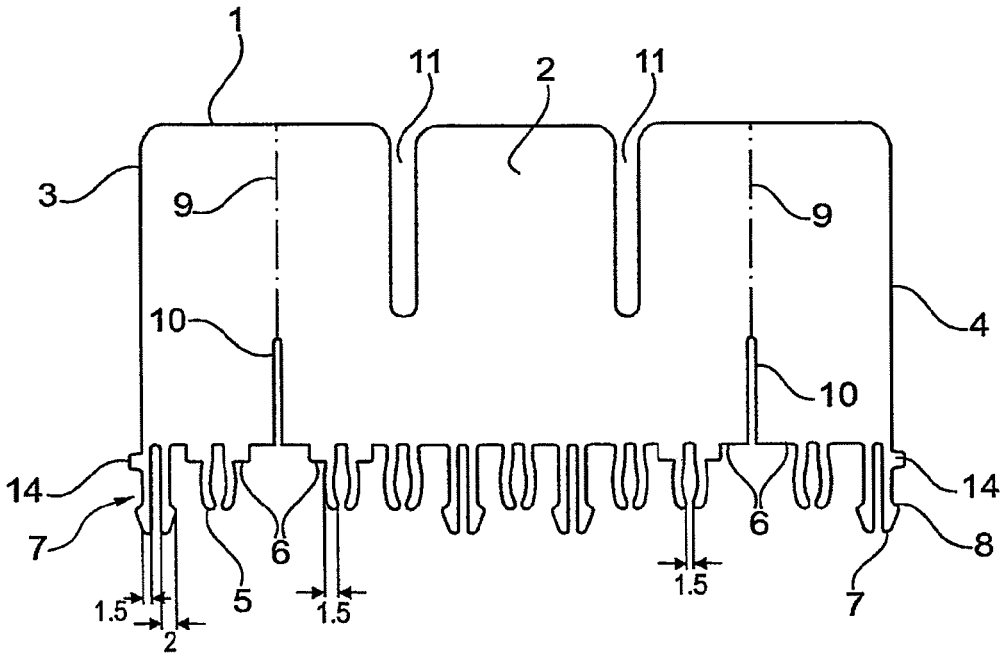

FIG. 13 differs from FIG. 1 essentially in that here the contact elements 5 and the spacer 6 are integrally formed from a single material, or integrally configured.

Below, exemplary embodiments of the second aspect of the invention are described.

Figure 14:
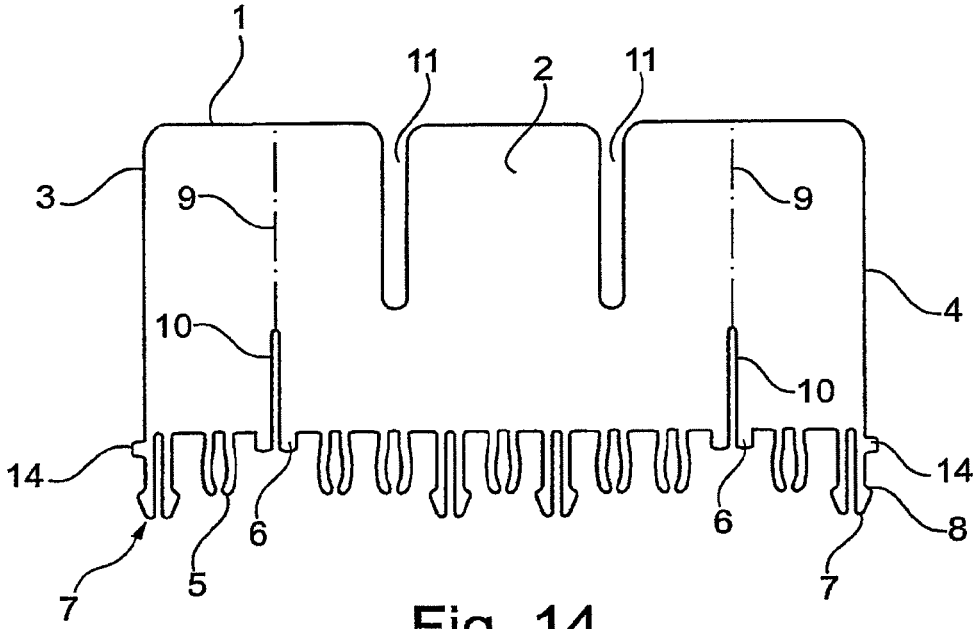
FIG. 14 shows the side view of a plug element according to the second aspect of the invention before the final fabrication.

FIG. 14 shows a sheet metal blank, still flat, as it appears after stamping out. This sheet metal blank should later form a plug element. It contains an upper edge 1 and a lower edge 2 arranged opposite thereto. Both edges are constructed parallel to each other. To the right and left the plug element in the Figure is bounded by a side edge 3, 4. On the lower edge 2 associated to the circuit board a total of seven contact elements 5 are constructed, which extend downwards over the lower edge 2 and which run parallel to each other. In addition to the contact elements 5 the metal blank of FIG. 14 contains on its lower edge 2 two spacing elements 6 and four safeguard elements 7. The safeguard elements 7 are longer than the contact elements 5. On their outer sides they have barbed hooks B.

The spacing elements 6 form a stop on their underside. Their length, measured from the lower edge 2 of the sheet metal blank, is shorter than that of the contact elements 5.

Parallel to the side edges 3, 4 the sheet metal blank comprises bending lines 9, in the extension of which narrow slits 10 are arranged. The slits 10 are intended to make bending easier.

From the flat position shown the sheet metal blank of FIG. 14 is deformed by bending the right and left areas outside the two bending lines about these bending lines by 90 degrees. Thereby, two wings surrounding a central part and extending parallel to each other evolve. This formation is apparent from FIG. 15. In the central part, two slits 11 are formed, starting from the upper edge 1. Due to this, between the two slits 11 a tongue 12 is formed which is bent slightly inwards, that is to say in the direction between the two outer wings 13. In this position the plug element is connected to the circuit board by inserting the safeguard elements 7 located on the underside 2 of the plug element and the contact elements 5 into plated-through holes arranged in the same arrangement. Since the safeguard elements 7 are longer than the contact elements 5, the safeguard elements 7 reach into the four associated holes first, wherein the angled shape on the front face of the safeguard elements 7 eases the insertion. As soon as the safeguard elements 7, which simultaneously represent positioning aids, have engaged in the holes, the contact elements 5 are aligned relative to the plated-through holes associated to them, so that they can now be inserted into the plated-through holes. The insertion movement is limited by the fact that the underside of the spacing elements 6 abuts against the top side of the circuit board. Thereby, then also the stops 14 which are present on the outer side in the region of the side edges 3, 4 abut on the upper side of the circuit board.

Figure 15:
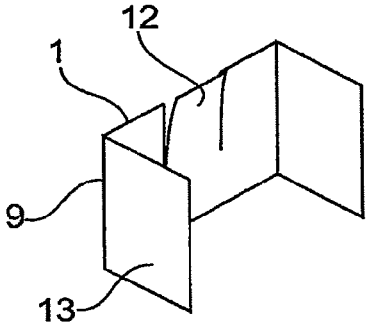
FIG. 15 includes, in a perspective view, the arrangement of two plug elements according to the second aspect of the invention on a circuit board.
Figure 15:
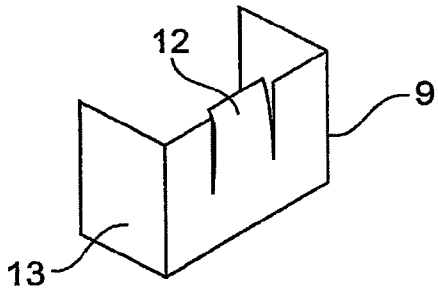

As can be taken from FIG. 15, two such plug elements are arranged opposite to each other. Between them they form a space, in which for example a battery can be placed which is held by the wings 13 and the central part in a mechanically restricted manner, and in which the contacting is achieved by means of the tongues 12.

Figure 16:
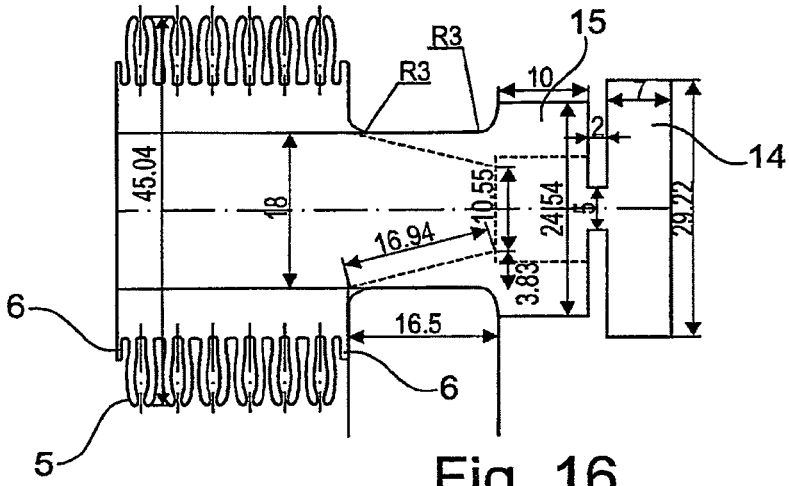
FIG. 16 shows the view of a metal blank for producing a plug element according to the second aspect of the invention.

FIG. 16 shows a sheet metal blank from which a further plug element can be produced by bending. On each of two long sides lying opposite each other the sheet metal blank contains six contact elements 5, which have the same shape as the contact elements 5 of the embodiment according to FIG. 14. At the ends of the site, where the contact elements 5 are arranged, spacing elements 6 are again formed, which form a stop for the insertion. On the right-hand side of the sheet metal blank, sheet sections 14 and 15 are formed, which serve to allow a cable to be passed around them and to be pressed together there. The sheet metal blank of FIG. 16 is bent in such a way that the two rows of contact elements 5 run parallel to each other, so that all contact elements 5 run parallel to each other. This is illustrated from the side in FIG. 17. FIG. 18 shows the arrangement of the finished bent sheet metal element from the right in FIG. 17. The sheet metal parts 14 are bent upwards, so that a cable can be inserted there, which is then pressed together with the sheet metal blank.

Figure 17:
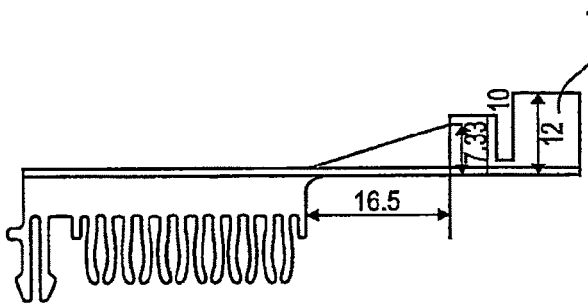
FIG. 17 shows the side view of the plug element according to the second aspect of the invention.
Figure 18:
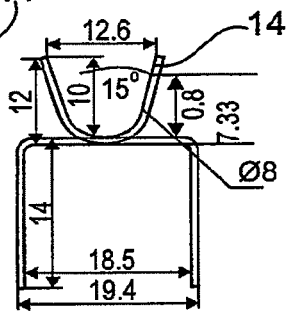
FIG. 18 shows the front view of the plug element of FIG. 17 according to the second aspect of the invention.
Figure 19:
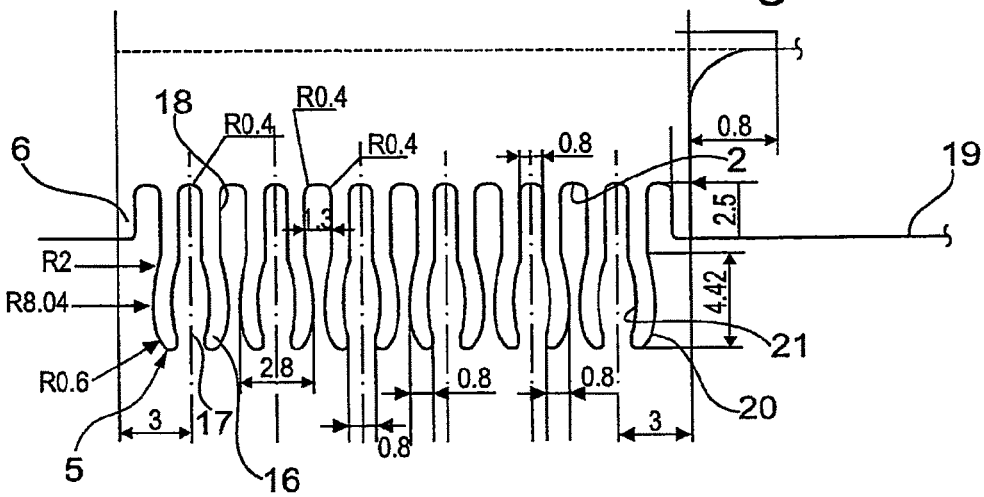
FIG. 19 shows, in enlarged scale, the arrangement of the contact elements in a plug element according to the second aspect of the invention.

Details of the contact elements 5 and the spacing elements 6 are evident from FIG. 19, which shows an enlarged illustration of the contact elements 5 of FIG. 17.

The ends of the spacing elements 6 in FIG. 19 directed downwards form the line which corresponds to the surface of the circuit board after the insertion of the plug elements into the circuit board. The contact elements 5 contain two legs 16, between which a slit 17 is formed. The legs 16 begin at the lower edge 2 of the plug element, at first with parallel side edges 18. A short distance below the mentioned surface plane 19, the outer edges 20 of the two legs facing away from each other run convexly curved outwards. This shape is also followed by the inner sides 21 of the legs 16 that face each other. The ends of the legs 16 are spaced apart from each other by a distance. In this way the legs 16 of the contact elements 15 can deform inwards, i.e. in a direction that run transversely to the insertion direction of the contact elements 5. The insertion direction directed from top to bottom in FIG. 17 and FIG. 19.

Figure 20:
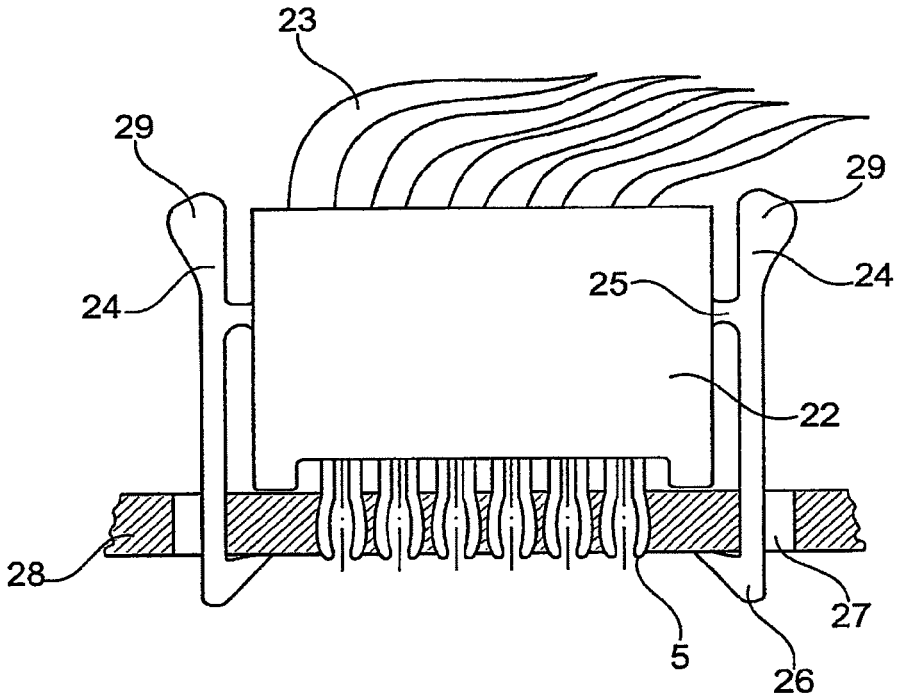
FIG. 20 schematically illustrates a plug as a plug element according to the second aspect of the invention.

While FIG. 14 and FIG. 15 show a plug element which serves as a holder for a component, and FIG. 16 to FIG. 19 show a plug element which is designed as a plug for a single cable, FIG. 20 now shows a plug element in which the contact elements 5 protrude from a housing 22. In the housing 22, connections with multiple cables 23 to the individual contact elements 5 are accommodated. This therefore represents a plug with a plurality of cables 23.

On the two sides of the housing 22 facing away from each other, levers 24 consisting of plastic are formed which can be tilted about the junction location 25. With their front ends 26 these levers 24 extend through the through holes 27 of the circuit board 28. At this end 26 each lever 24 is fitted with a barbed hook, which prevents pulling out of the hole 27 of the circuit board 28. The two levers 24 are pre-tensioned into this position illustrated, in which the barbed hooks abut at the rear of the circuit board 28. In order to pull the plug out, the two levers must be turned in such a way that the barbed hooks fit through the holes 27. The tilting can occur by pressing, at the end 29 facing away from the circuit board 28, the lever 24 inwards.

Figure 21:
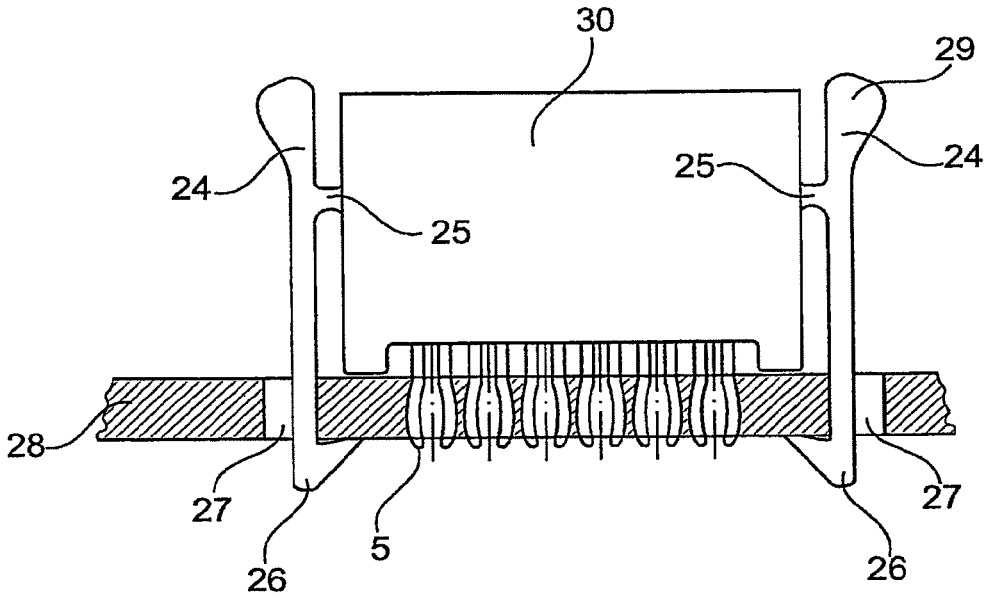
FIG. 21 shows the arrangement of a housing with contact elements according to the second aspect of the invention.

FIG. 21 shows an exemplary embodiment in which a housing 30 is provided with a series of contact elements 5, which are constructed in the same way as shown in FIG. 19. Again, levers 24 are formed on both sides of the housing 30, which have the same function as in the embodiment according to FIG. 20. Here, the contact elements 5 are in connection to electrical and/or electronic components inside the housing 30. These can be either simple or more complicated electronic components, also for example complete circuits.

Since the levers 24 with their front ends 26 considerably project beyond the front ends of the contact elements 5, and since the front ends are tapered to a point, these front ends of the levers 24 form a positioning aid by means of which the plug element can be aligned relative to the through holes 27 such that the contact elements 5 immediately find the through holes associated to them.

For connecting plug elements to circuit boards it is proposed that the circuit board has plated-through holes and the plug element has contact elements corresponding to the plated-through holes insertable into them. The contact elements and the plated-through holes are matched to each other in terms of their dimensions in such a manner that the plug element with the contact elements can manually be inserted into the plated-through holes. The plug element can also be manually removed again from the circuit board. So that, in spite of the connection being achievable with low force, a sufficient contacting between the contact elements and the wall of the plated-through holes can be established, it is provided that the contact elements are adapted to be elastic or flexible in the direction transverse to the insertion direction.

Figure 30:
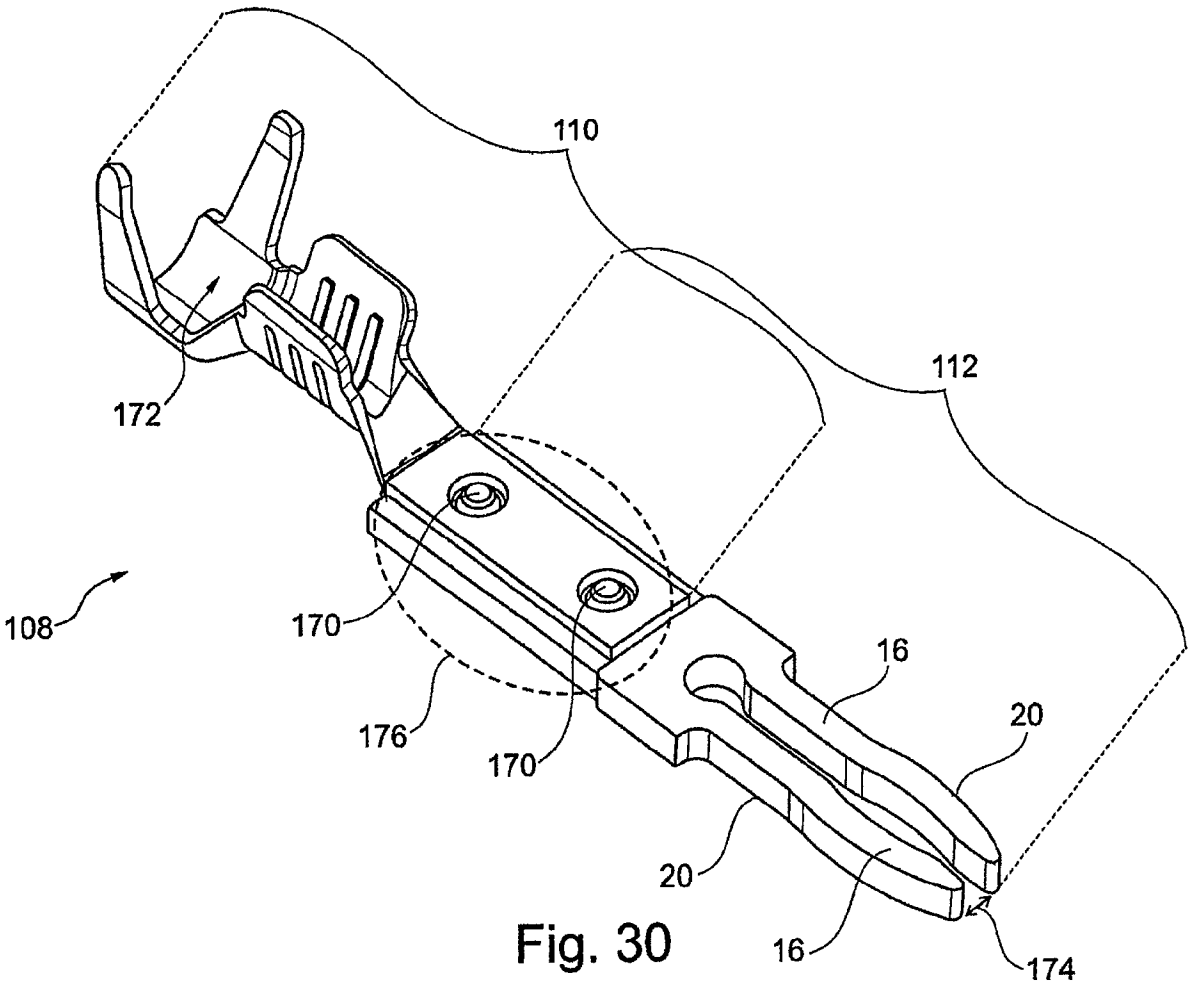
FIG. 30 to FIG. 32 illustrate contact elements of the connection arrangements according to FIG. 22 to FIG. 29.
Figures 31, 32:
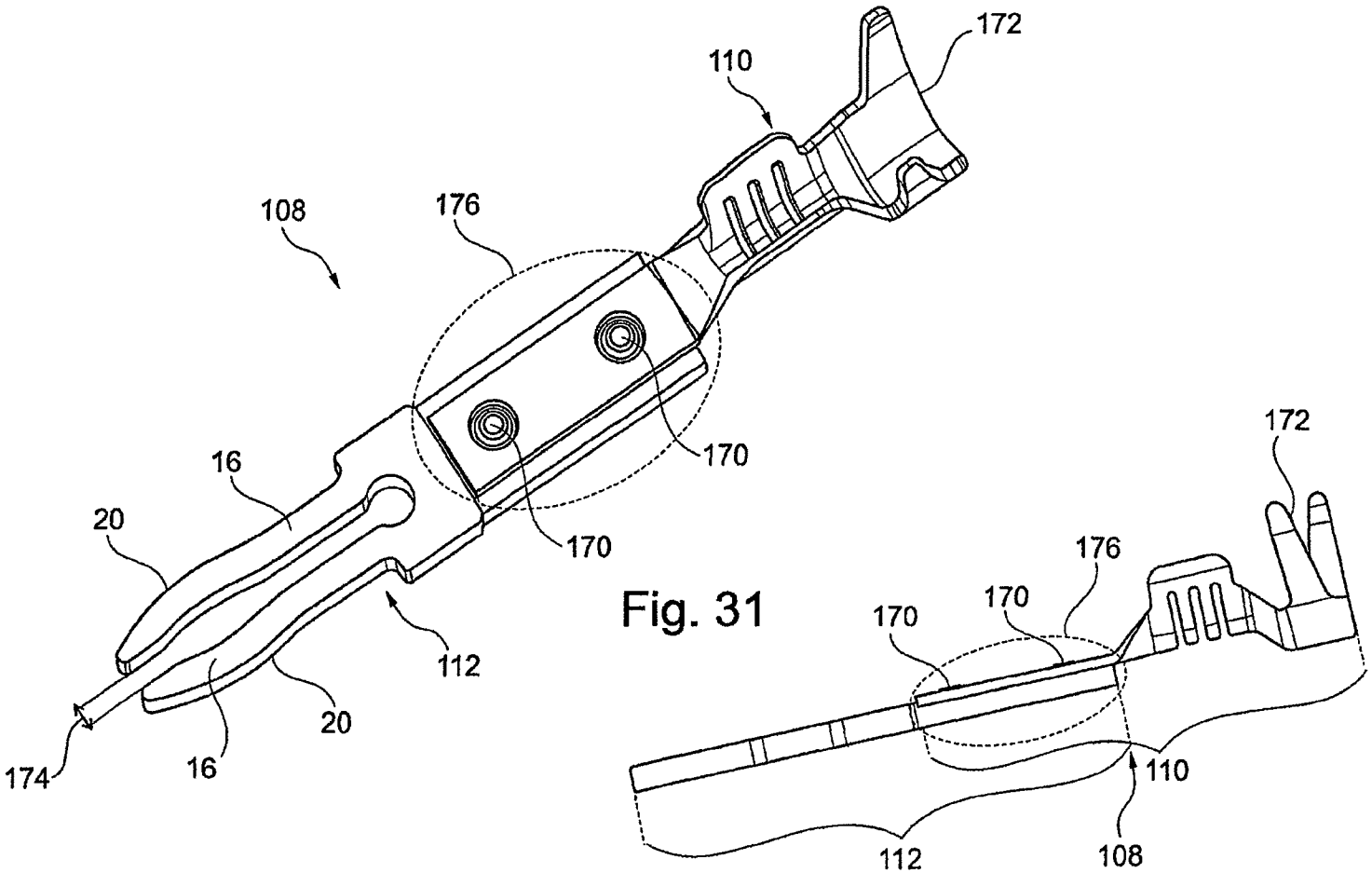

Below, vibration-robust connection arrangements according to other exemplary embodiments of the first aspect of the invention are described with reference to FIG. 22 to FIG. 29. FIG. 30 to FIG. 32 show associated contact elements for the connection arrangements according to FIG. 22 to FIG. 29.

Figure 22:
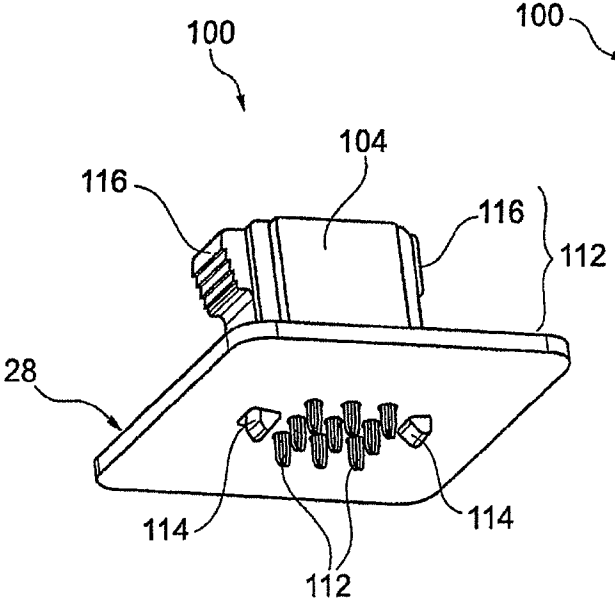

FIG. 22 shows a connection arrangement 100 according to another exemplary embodiment of the invention.

The connection arrangement 100 contains a plug element 102 and a circuit board 28. The plug element 102 contains, as shown better in FIG. 23, a housing 104 with a matrix-type arrangement of conductor receptacles 106 for receiving electrical conductors which are not shown. The circuit board 28 contains plated-through holes 54 in a correspondingly also matrix-shaped arrangement. The plug element 102 further contains a plurality of pluggable spring-type contact elements 108, also arranged in a matrix shape, which—or the tips of which—have a reversible deflection characteristic. In other words the contact elements 108 can be inserted many times into the plated-through holes 54 and removed from them again, without their reversible, Hookean, non-plastically deforming spring characteristics being changed.

The through holes 54 and the contact elements 108 pluggable into them are matched to one another such that the plug element 102 can be connected to the circuit board 28 by hand by insertion of the contact elements 108 into the holes 54, and thereafter can also be removed again by hand.

Figure 23:
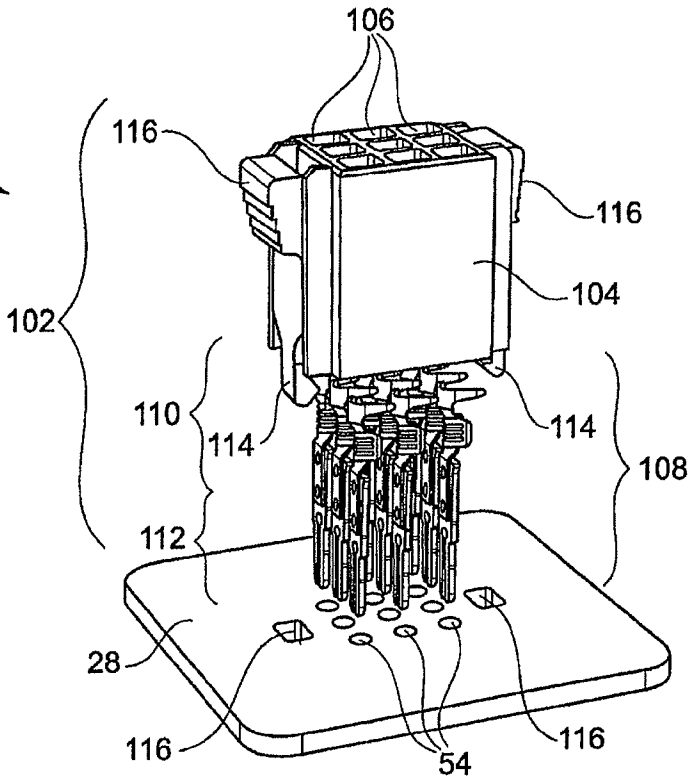
FIG. 22 to FIG. 29 show vibration-robust connection arrangements according to other exemplary embodiments of the first aspect of the invention.
Figure 24:
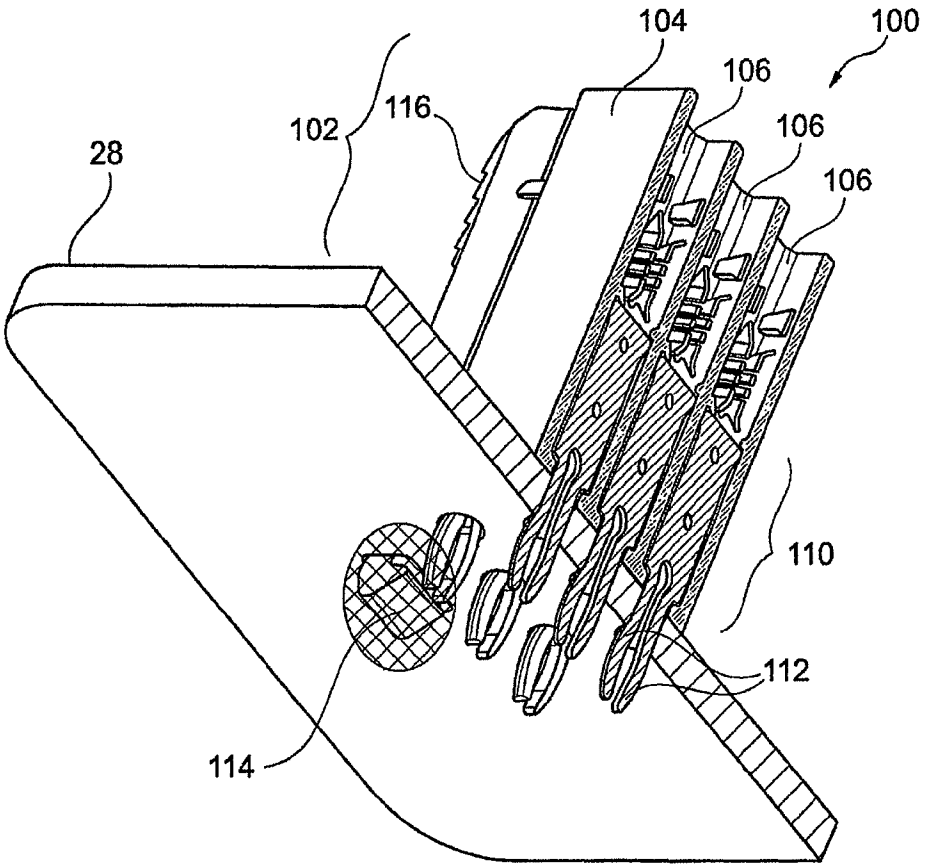

According to the exemplary embodiment of the connection arrangement 100 shown in FIG. 22 to FIG. 24 the contact elements 108 are configured as crimp contacts. These contact elements 108 contain a crimp-capable contact section 110 and an elastically insertable section 112, which is mounted on the crimp-capable crimp section 110. The crimp-capable crimp section 110 is made of different material compared to the elastically pluggable section 112 and can also be formed with a different material thickness than the elastically pluggable section 112.

According to the exemplary embodiment of the connection arrangement 100 shown in FIG. 22 to FIG. 24, the vibration-robust mechanical safeguard is adapted as a pair of locking clips 114, which are mounted on opposite lateral end sections of the housing 104. The locking clips 114 can be activated by a user by hand by means of a corresponding pair of handle pieces 116 in an upper end section of the housing 104. The locking clips 114 are configured to engage into correspondingly adapted lock receiving openings 116 on the circuit board 28.

FIG. 22 shows the connection arrangement 100 in a plugged-together condition, while FIG. 23 shows the connection arrangement 100 in a mutually separated condition. FIG. 24 shows the connection arrangement 100 in a cross sectional view. It is shown there how the elastically pluggable sections 112 are elastically received from the corresponding holes 54, wherein a reliable electrical contact is simultaneously established.

With the connection arrangement 100 according to FIGS. 22 to 24 thus a direct plugging is facilitated upon usage of locking clips 114. The plug element 102 is plugged into the board 28 and is locked there by means of the locking clips 114. A tolerance compensation of the circuit board thickness can be effected by deep milling at the underside of the circuit board 28.

Below, with reference to FIG. 25 and FIG. 26, a connection arrangement 130 according to another exemplary embodiment of the invention is described in a first operating state (FIG. 25) in which a plug element 132 is plugged into a circuit board 28, and, with reference to FIG. 26, in a condition in which the plug element 132 is not plugged into the circuit board 28.

Figure 26:
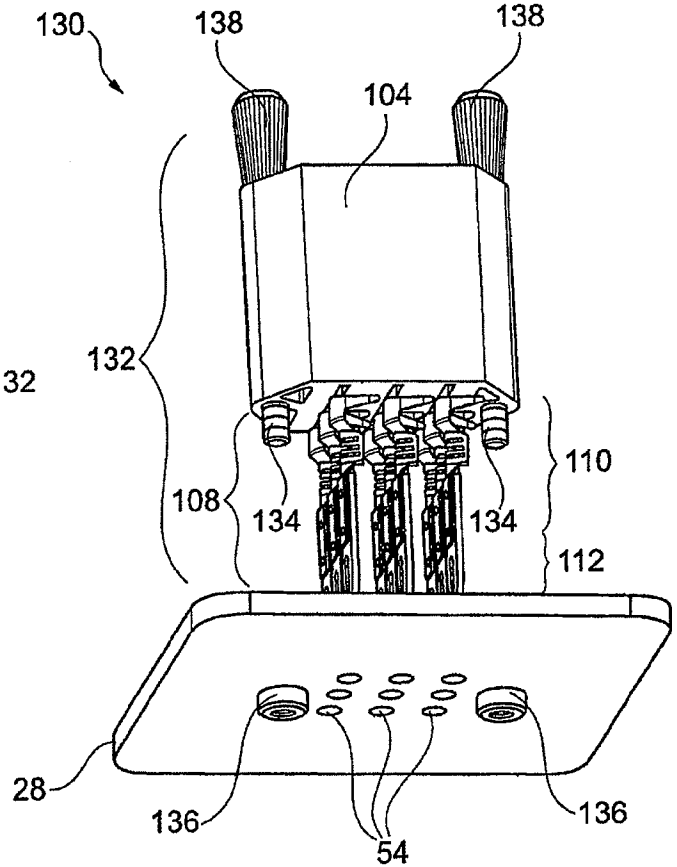
Figure 25:
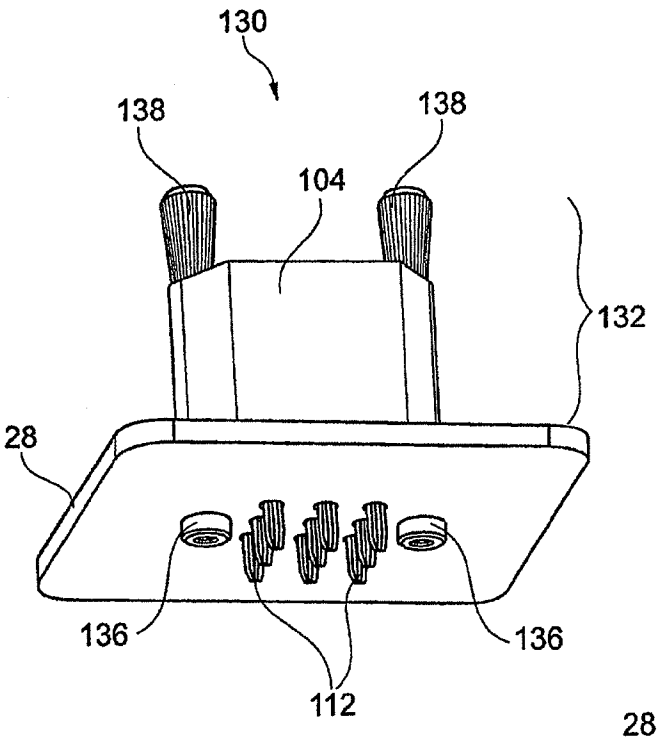

According to FIG. 25 and FIG. 26 a vibration-robust mechanical safeguard is adapted as a pair of screw elements 134, arranged on laterally opposite lower end sections of the housing 104, and configured for engaging in a correspondingly adapted threaded sleeve 136 of the circuit board 28. Put another way, a threaded sleeve 136 comprising an internal thread which corresponds to an outer thread of the respective screw element 134, is pressed into the circuit board 28 at of two points, respectively. By means of rotational activation of activation elements 138 in an upper end section of the housing 104 the plug element 132 can thus be fixedly screwed to the circuit board 28 by hand after being plugged into it. The threaded sleeves 136 can also be screwed or alternatively pressed to the board or circuit board 28. Thickness tolerances of the board or circuit board 28 can be compensated via a screw insertion depth.

Figure 28:
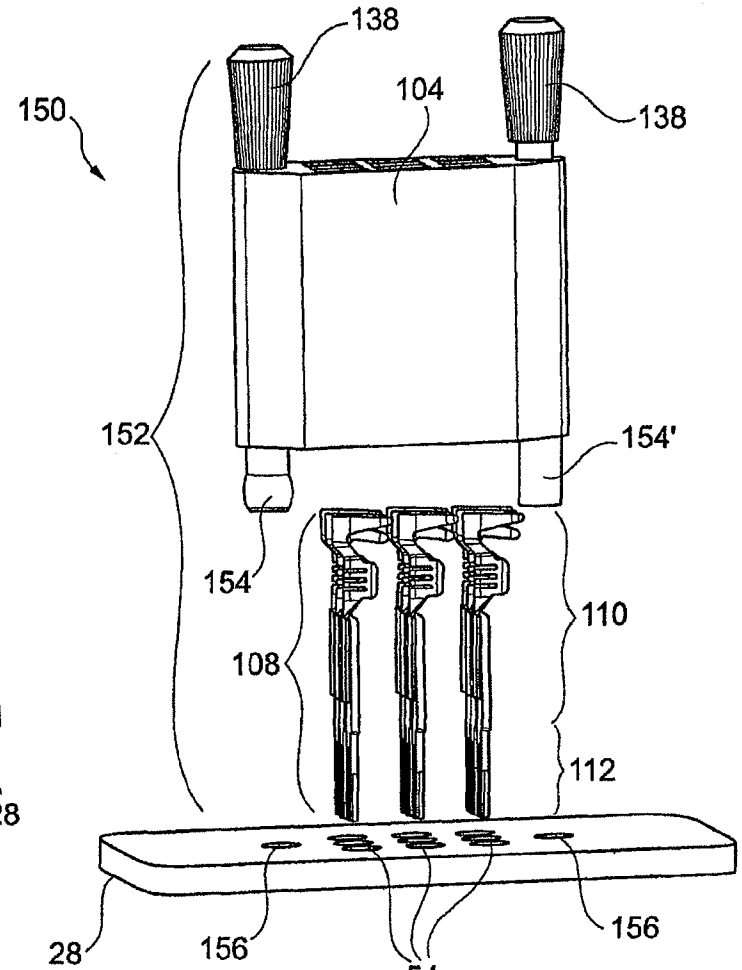
Figure 27:
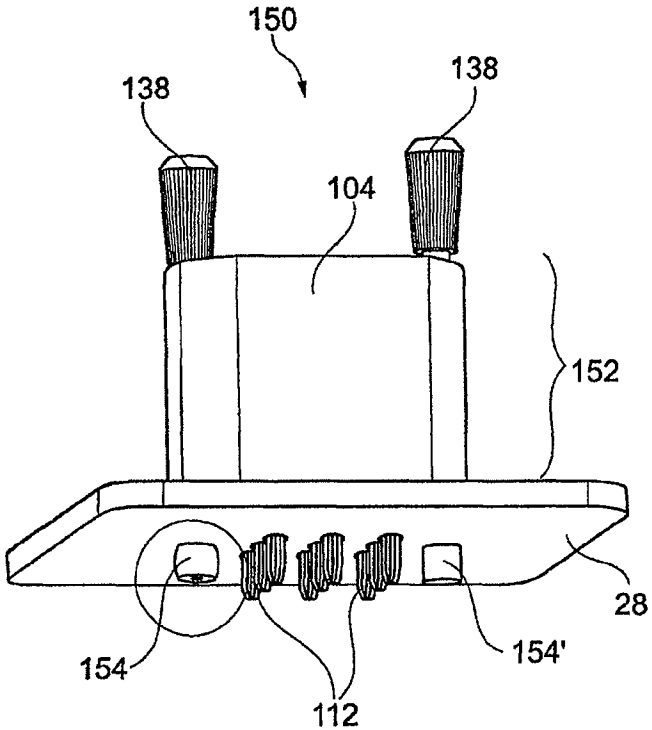
Figure 29:
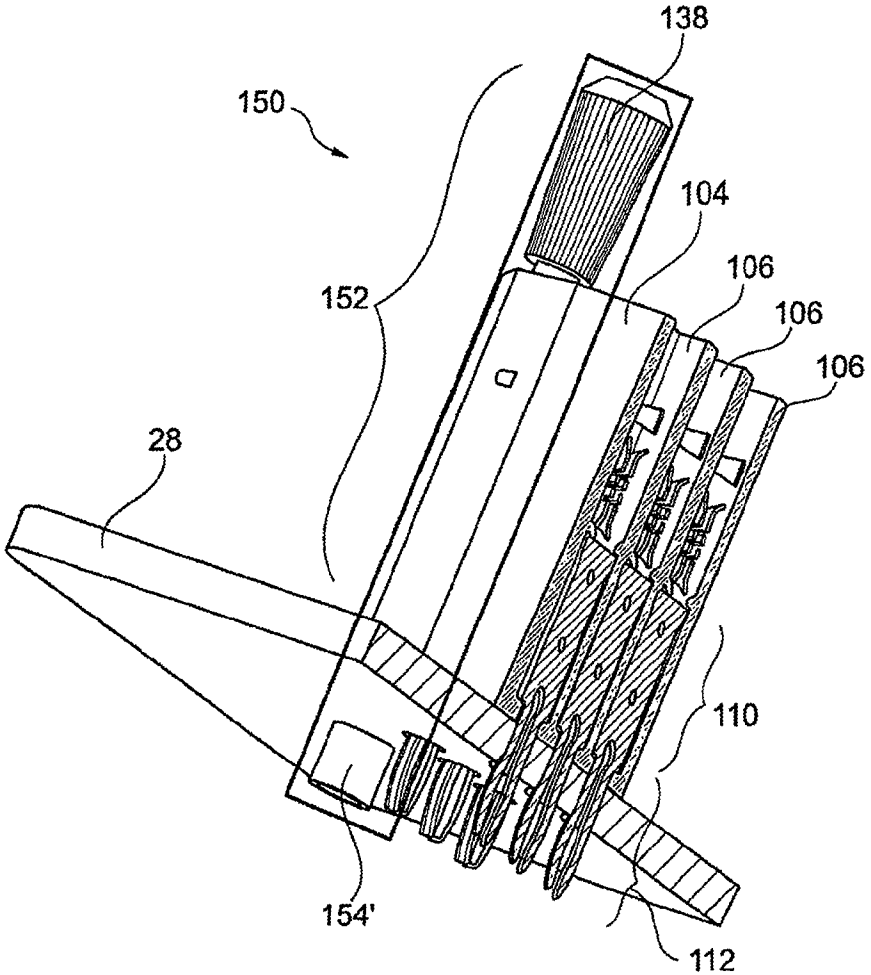

FIG. 27 to FIG. 29 show different views of a connection arrangement 150 according to yet another exemplary embodiment of the invention, in which again a vibration robustness and optionally a high-current capability is enabled.

FIG. 27 shows a plug element 152 in a circuit board 28 in the inserted condition, whereas according to FIG. 28 the pluggable element 152 is shown in an un-plugged condition with respect to the circuit board 28. FIG. 29 shows a partial cross-section through the connection arrangement 150, with the aid of which the springy elastic reception characteristics of the electrically pluggable sections 112 of the plug elements 152 can be recognized.

According to FIG. 27 to FIG. 29 the vibration-robust mechanical safeguard is implemented by using a pair of expanding rivets 154, 154', which can be activated by means of activation elements 138 and can be inserted and fastened into correspondingly provided rivet receiving holes 156 in the circuit board 28. Thus, according to FIG. 27 to FIG. 29, the direct plugging is implemented by means of expanding rivets 154, 154', wherein the respective rivet bolts can be pressed in and can be variably expanded. Tolerances in the thickness of the board, that is to say in the thickness of the circuit board 28, can be compensated. FIG. 28 shows an active expanding rivet 154 and an inactive expanding rivet 154'. In the inside of the housing 104 the associated expanding rivet bolts are arranged.

FIG. 30 to FIG. 32 show a detailed view of the contact elements 108 configured as crimp contacts.

FIG. 30 shows that the crimp-capable crimp section 110 and the elastically pluggable section 112 is mechanically and electrically realized by using a combined embossing and rivet connection 170. In order to implement the elastically pluggable section 112 a tuning-fork contact is again provided for holes having a diameter of 2.3 mm to 2.5 mm. As material for the elastically pluggable section 112, e.g. Wieland K55 or Wieland K88 with a material thickness of 0.8 mm can be used. The crimp-capable crimp section 110 contains a crimp zone 172 for a cable reception having a cross-sectional area between 1.5 $mm^2$ and 2.5 $mm^2$. As material for the crimp-capable crimp section 110, for example bronze $CuSn_6$ with a material thickness of 0.4 mm can be used.

The actual contacting elements of the electrically pluggable sections 112 comprise two legs 16 leaving an intervening space 174 between them, the outer sides 20 of which, facing away from each other, are convexly curved designed. FIG. 30 shows that the sections 110, 112 overlap in an overlap region 176 and that they are there connected together by means of the embossing and rivet connection 170.

FIG. 31 shows another spatial view and FIG. 32 shows a side view of the contact element 108.

Additionally it is to be pointed out that "comprising" does not exclude any other elements or steps and "one" or "a" does not exclude a plurality. It should further be pointed out that features or steps which have been described by reference to one of the above exemplary embodiments can also be used in combination with other features or steps of other exemplary embodiments described above. Reference numbers in the claims are not be regarded as limiting.

The invention claimed is:

1. Connection arrangement, having a plug element, which comprises a plurality of pluggable contact elements extending parallel to one another, and having a circuit board with plated-through holes, which are arranged in an arrangement corresponding to the arrangement of the contact elements of the plug element, wherein the plated-through holes and the contact elements pluggable into them are matched to each other in such a manner that the plug element is manually connectable to the circuit board by inserting the contact elements into the plated-through holes and the plug element is manually removable, wherein the contact elements are simultaneously pluggable into their associated plated-through holes, wherein each of the contact elements comprise two legs having a space between them, both legs of each of the contact elements pluggable into a respective plated-through hole, and wherein the connection arrangement is provided with a mechanical safeguard against unintentional withdrawal of the plug element from the circuit board, the mechanical safeguard formed by a separate latch structure that is entirely distinct from the contact elements of the plug element.

2. The connection arrangement according to claim 1, having a stop for limiting the insertion of the contact elements into the circuit board.

3. The connection arrangement according to claim 1, in which the contact elements are flexible in a direction transverse to the insertion direction, at least in the region to be arranged inside the plated-through holes.

4. The connection arrangement according to claim 1, in which the outer sides of the legs face away from each other and are designed with a convex curvature.

5. The connection arrangement according to claim 1, in which the mechanical safeguard is adapted to connect the plug element and the circuit board with a mechanical fixing force of at least 100 N, in particular of at least 200 N, further in particular of at least 300 N.

6. The connection arrangement according to claim 1, in which every pluggable contact element is adapted for an electrical loading capacity of at least 5 Amperes, in particular of at least 10 Amperes, further in particular of at least 20 Amperes.

7. The connection arrangement according to claim 1, in which every pluggable contact element is adapted to be insertable into one of the through holes with an insertion force of 10 N.

8. The connection arrangement according to claim 1, in which the mechanical safeguard and the pluggable contact element or the pluggable contact elements are provided as components that are insulated from each other and separately mounted on the plug element.

9. The connection arrangement according to claim 1, wherein at least one of the mechanical safeguard and the pluggable contact elements, the mechanical safeguard and the stop, and the pluggable contact elements and the stop are provided as components mounted jointly on the plug element.

10. The connection arrangement according to claim 1, wherein at least one additional hole of the circuit board is covered with a protective material.

11. The connection arrangement according to claim 1, wherein the vibration-robust mechanical safeguard is adapted as at least one locking clip, which is configured to engage in a correspondingly designed lock receiving opening of the circuit board.

12. The connection arrangement according to claim 1, wherein the contact elements are configured such that when plugging in the contact elements by hand into the holes, the contact elements are only deformed in the elastic range.

13. A vehicle, comprising a connection arrangement according to claim 1.

14. The vehicle according to claim 13, configured as one of a group consisting of a powered vehicle, a passenger car, a motor truck, a bus, a powered agricultural vehicle, a baling press, a combine harvester, a self-propelled sprayer, a road building machine, a tractor, an aircraft, an aeroplane, a helicopter, a spaceship, a Zeppelin, a water-borne vehicle, a ship, a railway vehicle, and a train.

15. A plug element for a connection arrangement for connection to a circuit board with plated-through holes, wherein the plug element comprises:

a plurality of pluggable contact elements extending parallel to one another, with a reversible deflection characteristic, wherein the plated-through holes are arranged in an arrangement corresponding to the arrangement of the contact elements of the plug element, wherein the holes and the contact elements pluggable into them are matched to one another in such a manner that the plug element is manually connectable to the circuit board by inserting the contact elements into the holes, wherein the contact elements are simultaneously pluggable into their associated plated-through holes, wherein each of the contact elements comprise two legs having a space between them, both legs of each of the contact elements pluggable into a respective plated-through hole, and wherein the plug element is provided with a mechanical safeguard against unintentional withdrawal of the plug element from the circuit board, the mechanical safeguard formed by a separate latch structure that is entirely distinct from the contact elements of the plug element.

16. The connection arrangement according to claim 1, wherein the contact elements are configured as crimp contacts.

17. The connection arrangement according to claim 16, wherein the crimp contacts comprise a crimp-capable crimping section and an elastically pluggable section.

18. The connection arrangement according to claim 17, wherein the crimp-capable crimping section and the elastically pluggable section are formed from different materials.

19. The connection arrangement according to claim 17, wherein the crimp-capable crimping section is formed with a thinner material thickness than the elastically pluggable section.

* * * * *